US010314360B2

(12) United States Patent
Sullivan et al.

(10) Patent No.: US 10,314,360 B2
(45) Date of Patent: Jun. 11, 2019

(54) RECONFIGURABLE SHOES AND APPAREL AND DOCKING ASSEMBLY THEREFOR

(71) Applicant: Code Fluidics LLC, San Diego, CA (US)

(72) Inventors: Benjamin David Sullivan, San Diego, CA (US); Nicole Justis Truitt, San Diego, CA (US)

(73) Assignee: CODE FOOTWEAR, LLC, Medina, WA (US)

( * ) Notice: Subject to any disclaimer, the term of this patent is extended or adjusted under 35 U.S.C. 154(b) by 0 days.

(21) Appl. No.: 15/275,445

(22) Filed: Sep. 25, 2016

(65) Prior Publication Data

US 2017/0006956 A1 Jan. 12, 2017

Related U.S. Application Data

(63) Continuation of application No. 13/389,578, filed as application No. PCT/US2010/045380 on Aug. 12, 2010, now abandoned.

(60) Provisional application No. 61/233,776, filed on Aug. 13, 2009.

(51) Int. Cl.

| | |
|---|---|
| ***A43B 1/00*** | (2006.01) |
| ***A43B 3/00*** | (2006.01) |
| ***A43B 23/24*** | (2006.01) |
| *G09F 3/00* | (2006.01) |
| *A41D 27/08* | (2006.01) |
| *G09F 9/37* | (2006.01) |
| *A43B 19/00* | (2006.01) |

(52) U.S. Cl.

CPC ..... *A43B 1/0027* (2013.01); *A43B 1/0054* (2013.01); *A43B 1/0072* (2013.01); *A43B 3/0078* (2013.01); *A43B 23/24* (2013.01); *A41D 27/08* (2013.01); *A43B 1/0036* (2013.01); *A43B 19/00* (2013.01); *G09F 3/00* (2013.01); *G09F 9/372* (2013.01); *Y10T 137/8593* (2015.04)

(58) Field of Classification Search

CPC ... A43B 3/0078; A43B 1/0027; A43B 1/0072; A43B 19/00; A43B 1/0036; A43B 23/24; A43B 1/0054; G09F 3/00; G09F 9/372; A41D 27/08; Y10T 137/8593

See application file for complete search history.

(56) References Cited

U.S. PATENT DOCUMENTS 4,659,619 A * 4/1987 Tate ..... B43L 1/008 346/21
5,375,044 A * 12/1994 Guritz ..... A41D 27/085 362/103
5,379,533 A * 1/1995 Swartz ..... A43B 1/0036 36/136
5,771,810 A * 6/1998 Wolcott ..... B41J 2/005 101/483
5,784,807 A * 7/1998 Pagel ..... A43B 1/0009 36/153

(Continued)

*Primary Examiner* — Jack Yip

(74) *Attorney, Agent, or Firm* — Noon Intellectual Property Law, P.C.

(57) ABSTRACT

Provided herein are methods for the modulation of appearance or material properties within items of apparel or equipment. Also provided herein are design articles having alterable designs. Generally, such design articles comprise (1) a microfluidic circuit, and (2) an inlet and an outlet, the alterable design capable of being modulated through use of a docking system to deliver fluid to the microfluidic circuit.

20 Claims, 17 Drawing Sheets

(56) References Cited

U.S. PATENT DOCUMENTS

2002/0176804 A1* 11/2002 Strand ..... G01N 35/028
422/511
2003/0045607 A1* 3/2003 Ichikawa ..... C09D 11/18
523/160
2003/0077836 A1* 4/2003 Beebe ..... B01L 3/5027
436/169
2004/0201878 A1* 10/2004 Agrawal ..... G02F 1/155
359/266
2004/0237164 A1* 12/2004 Aperfine ..... A41D 3/04
2/69
2006/0141234 A1* 6/2006 Rearick ..... C08G 18/12
428/304.4
2006/0215000 A1* 9/2006 Kachi ..... B41J 2/17556
347/85
2006/0290755 A1* 12/2006 Lee ..... B41J 2/155
347/86
2008/0038839 A1* 2/2008 Linder ..... B01L 3/0293
436/501
2008/0141433 A1* 6/2008 Rhodes-Vivour ..... A42B 1/004
2/69
2008/0273918 A1* 11/2008 Linder ..... B01L 3/5027
403/31
2008/0279253 A1* 11/2008 MacDonald ..... A41D 13/002
374/162
2009/0046760 A1* 2/2009 Matheson ..... A41D 13/005
374/141
2013/0263352 A1* 10/2013 Crockett, Jr. ..... A41D 13/0015
2/69
2014/0230115 A1* 8/2014 Shelley ..... A41D 29/00
2/16

* cited by examiner

RECONFIGURABLE SHOES AND APPAREL AND DOCKING ASSEMBLY THEREFOR

CROSS REFERENCE TO RELATED APPLICATION

This is a continuation of U.S. application Ser. No. 13/389,578, which is a national stage entry of PCT/US10/45380, filed Aug. 12, 2010, which claims the benefit of U.S. Provisional Application No. 61/233,776, filed 13 Aug. 2009. These applications are incorporated by reference in their entireties.

FIELD

The present invention relates to the modulation of appearance or material properties within items of apparel or equipment. In particular, the present invention relates to fluidic manipulation of appearance or material properties and modulation thereof, including (1) a microfluidic circuit within an item, (2) an inlet and an outlet, and (3) a docking system to deliver fluid to the microfluidic circuit.

BACKGROUND

There has always been the desire to express oneself through color. The ability to modulate the appearance or material properties of apparel, equipment or other items had previously required discrete components, for instance distinct pairs of shoes to coordinate with different outfits, different belts, or different color vehicles. Further, apparel, sporting equipment and other items are often provided for consumption in a manner illustrating one or more design feature. Generally, such design features are immutable. Consumers wishing to have a different design feature on an article that they already own are generally forced to purchase a second version of the article. The purchase of two or more versions of an identical article to simply provide a new design is extremely inefficient. Provided herein are articles and methods whereby such inefficiences are overcome.

SUMMARY

Provided herein are articles having one or more design element that is capable of being modified. In some instances, an article or design element provided herein comprises a fluidic circuit. Generally, such fluidic circuit has at least one opening (e.g., inlet and/or outlet) through which fluid may transgress (e.g., ingress through an inlet and egress through an outlet). In specific instances, such fluidic circuits are liquid circuits. In further or alternative embodiments, such fluidic circuits are microfluidic circuits.

In items such as apparel (e.g., footwear, shoes, belts, backpacks, hats, bracelets, wristbands, shirts, scarves, jewelry, glasses, materials for apparel, release papers, fibers, etc.), equipment (e.g., skateboards, rollerblades, snowboards, gloves, pads, appliances, computers, electronics, gadgets, toys, etc.), and other three-dimensional objects (signs, corporate art, corporate logos, military vehicles, military gear, helmets, vehicle body panels, housewares, furniture, tabletops, walls, paintings, etc.), embodiments of the present invention provide for incorporation of one or a plurality of microfluidic circuits within the item to allow for the modulation of color or other material properties of the item. In specific embodiments, this modulation can be readily achieved by the user of the item.

In one embodiment, a microfluidic circuit provided for herein wraps around a substructure (e.g., a design element) of the item. Inlets to, and outlets from a microfluidic circuit provided herein may be co-located within a port portion of the item. In certain embodiments, the inlets and outlets may carry valves, caps, or other seals to mitigate evaporation or backflow. In some instances, a port facilitates connection of the microfluidic circuit to a docking station. In particular, a useful port may provide for a well-sealed interface between the microfluidic circuit and a docking station (e.g., between inlet and/or outlet of the microfluidic circuit and a connector emanating from a docking station). In specific embodiments, the connector is the male complement to a female port. In certain embodiments the docking station comprises a pump, a mixer, valves, one or more color cartridge(s), a connector, a waste compartment, a computer controlled interface, a combination thereof, or all of the above. In certain embodiments, a user may select a color or a combination of colors that are mixed within the docking station and dispensed through the microfluidic circuit of the item. In other embodiments, the docking station is comprised of pressurized cartridges that dispense and collect fluid when connected to the item.

Some embodiments disclosed herein include a system comprising a design article and a docking system, the design article comprising a fluidic circuit, the fluidic circuit comprising: (i) a fluidic channel; (ii) an inlet valve; and (iii) an outlet valve; the fluidic channel connecting the inlet valve and the outlet valve; and the docking system comprising a mechanical/fluidic interface for delivering ink to the fluidic circuit.

In some embodiments, the design article is apparel. In some embodiments, the apparel is footwear. In some embodiments, the apparel is a hat, backpack, bracelet, wristband, shirt, socks, or jewelry. In some embodiments, the design article is a baseball glove, hockey pad, skateboard deck, snowboard deck, rollerblade, football pads, or lacrosse sticks.

In some embodiments, the fluidic channel is a microfluidic channel. In some embodiments, the fluidic circuit comprises a plurality of microfluidic channels, the plurality of microfluidic channels connecting the inlet valve to the outlet valve. In some embodiments, fluidic channel is enclosed by a body, the body comprising on at least one side a transparent or translucent portion. In some embodiments, the fluidic channel is constructed of a transparent or translucent polymer.

In some embodiments, the design article comprises a connection region housing the inlet and outlet valves, the connection region facilitating alignment of the inlet and outlet valves of the fluidic circuit with the mechanical/fluidic interface of the docking system.

In some embodiments, the docking station comprises a compartment that houses one or more ink cartridges, the one or more ink cartridges comprising a cartridge chamber containing ink, the one or more cartridge chamber connected to the mechanical/fluidic interface.

In some embodiments, wherein the cartridge chamber is connected to the mechanical/fluidic interface through a conduit for transporting ink. In some embodiments, the conduit comprises at least one valve. In some embodiments, the conduit comprises at least one mixing chamber suitable for mixing inks.

In some embodiments, the docking station comprises a propulsion system for propelling ink through the mechanical/fluidic interface. In some embodiments, the propulsion system for propelling ink comprises a pump, a pressurized propellant, or a combination thereof.

In some embodiments, the one or more ink cartridge comprises a hydrophobic ink. In some embodiments, the one or more ink cartridge comprises ink that remains fluid under ambient conditions for at least 24 hours.

Some embodiments disclosed herein include a design article comprising a fluidic circuit, the fluidic circuit comprising: (i). a fluidic channel; (ii) an inlet valve; and (iii) an outlet valve; the fluidic channel connecting the inlet valve and the outlet valve.

In some embodiments, the design article is apparel. In some embodiments, the apparel is footwear. In some embodiments, the apparel is a hat, backpack, bracelet, wristband, shirt, socks, or jewelry. In some embodiments, the design article is a baseball glove, hockey pad, skateboard deck, snowboard deck, rollerblade, football pads, or lacrosse sticks. In some embodiments, the fluidic channel is a microfluidic channel.

In some embodiments, wherein the fluidic circuit comprises a plurality of microfluidic channels, the plurality of microfluidic channels connecting the inlet valve to the outlet valve.

In some embodiments, the fluidic channel is contained by a body, the body comprising on at least one side a transparent or translucent portion. In some embodiments, the fluidic channel is constructed of a transparent or translucent polymer.

In some embodiments, the design article further comprises a connection region housing the inlet and outlet valves, the connection region facilitating alignment of the inlet and outlet valves of the fluidic circuit with a mechanical/fluidic interface of a docking system for delivering ink into the fluidic circuit. In some embodiments, the fluidic circuit contains therein an ink.

In some embodiments, the design article further comprises an identification device for communicating with a docking system, the docking system suitable for delivering ink into the fluidic circuit. In some embodiments, the identification device is an EEPROM or RFID tag. In some embodiments, the identification device is located in the connection region.

Some embodiments disclosed herein include a docking station suitable for delivering fluid into a vessel, the docking station comprising (a) a compartment that houses one or more ink cartridges, the one or more ink cartridges comprising a cartridge chamber containing ink, and (b) a mechanical/fluidic interface, the one or more cartridge chamber connected to the mechanical/fluidic interface.

In some embodiments, the vessel is a fluidic channel comprising an inlet valve through which the docking station delivers ink.

In some embodiments, wherein the one or more ink cartridge comprises at least one disposable ink cartridge is removable and disposable.

In some embodiments, wherein the one or more ink cartridge comprises at least one integrated ink cartridge that is integrated into the docking station, and comprises at least one inlet suitable for charging the cartridge chamber of the integrated ink cartridge with ink.

In some embodiments, the cartridge chamber is connected to the mechanical/fluidic interface through a conduit for transporting ink. In some embodiments, the conduit comprises at least one valve. In some embodiments, the conduit comprises at least one mixing chamber suitable for mixing inks.

In some embodiments, the docking station further comprises a propulsion system for propelling ink through the mechanical/fluidic interface. In some embodiments, the propulsion system for propelling ink comprises a pump, a pressurized propellant, or a combination thereof.

In some embodiments, the one or more ink cartridge comprises a hydrophobic ink. In some embodiments, the one or more ink cartridge comprises ink that remains fluid under ambient conditions for at least 24 hours.

Some embodiments disclosed herein include an ink cartridge comprising a chamber, the chamber comprising an ink that remains fluid under ambient conditions for at least 24 hours; and an outlet, wherein the ink cartridge is suitable for delivering ink into a microfluidic channel.

Some embodiments disclosed herein include a microfluidic circuit comprising an enclosed microfluidic channel, an inlet valve and an outlet valve, the inlet valve and the outlet valve being connected via the microfluidic channel.

In some embodiments, the inlet valve and the outlet valve are connected via a plurality of microfluidic channels.

In some embodiments, the microfluidic channel(s) is enclosed by a body, the body comprising on at least one side a transparent or translucent portion.

In some embodiments, the body comprises or is constructed of a transparent or translucent polymer.

In some embodiments, the microfluidic circuit containing within the microfluidic channel(s) an ink. In some embodiments, wherein the ink remains fluid under ambient conditions for at least 24 hours.

Some embodiments disclosed herein include a method of modulating the design elements within apparel or equipment comprised of a fluidic circuit within the layers of the apparel or equipment, valves to control evaporation within the fluidic system, and a docking system to deliver fluid to the design elements.

In some embodiments, wherein the apparel is footwear.

In some embodiments, the apparel is a hat, backpack, bracelet, wristband, shirt, socks, or jewelry. In some embodiments, the equipment is a baseball glove, hockey pad, skateboard deck, snowboard deck, rollerblade, football pads, or lacrosse sticks.

In some embodiments, the valves comprise septum valves, multiport valves, check valves, pinch valves, or a combination thereof. In some embodiments, the valves are contained within a connection region.

In some embodiments, the connection region facilitates the mechanical interface between the valves and the dock. In some embodiments, the connection region facilitates the alignment of the mechanical interface between the valves and the dock through molded guides, ramps, snaps, levers, or grooves.

In some embodiments, the connection region is recessed within the back of a shoe. In some embodiments, the connection region is recessed within the bottom of a shoe.

In some embodiments, fluidic circuit is constructed from transparent or translucent plastics.

In some embodiments, the fluidic circuit is constructed of a transparent plastic such as polymethylmethacrylate, cellulose acetate butyrate, polycarbonate, glycol-modified polyethylene terphthalate, or polydimethylsiloxane.

In some embodiments, the fluidic circuit is formed between the outer item material and transparent plastic.

In some embodiments, the fluidic circuit is formed between a backing material and transparent plastic. In some embodiments, the backing material is sewn or adhered to the outer material of the item. In some embodiments, the backing material is comprised of a reflective material, such as biaxially-oriented polyethylene terphthalate.

In some embodiments, the material of the fluidic circuit is treated to reduce adsorption of resident dyes.

In some embodiments, the material of the fluidic circuit is treated to reduce evaporation of resident dyes.

In some embodiments, the capability to modulate design elements is self-contained within the apparel, through the use of liquid crystals, nano-ink, e-ink, or electronically reconfigurable nanoparticle suspensions.

In some embodiments, the fluidic circuit has a vertical extent on the order of 50-1,000 μm.

In some embodiments, the fluidic circuit has a vertical extent on the order of 100-200 μm.

In some embodiments, the fluidic circuit is classified as microfluidic.

In some embodiments, the fluidic circuit is comprised of a plurality of microfluidic channels.

In some embodiments, the plurality of microfluidic channels act as lenses.

In some embodiments, the fluidic circuit is configured to promote plug flow.

In some embodiments, the fluidic circuit contains elements to promote mixing.

In some embodiments, the mixing elements are comprised of one or more flow splitting elements, hydrodynamic focusing elements, capillary flow splitting and recombination elements, flow twisting elements, elements to promote chaotic advection, or grooves to promote mixing.

In some embodiments, colors are mixed in the dock before being delivered to the design elements. In some embodiments, design elements are modulated by replacing resident dyes with novel dyes.

In some embodiments, the residual dyes are flushed with a transparent solvent prior to the introduction of novel dyes. In some embodiments, the transparent solvent comprised of one or more of water, aqueous solution, ethanol, glycerol, or polyethylene glycol.

In some embodiments, the residual dyes are not flushed with a transparent solvent prior to the introduction of novel dyes.

In some embodiments, the residual dyes are displaced by novel dyes through diffusion, plug flow, fully developed Poiseuille flow, or mixing dynamics inherent within the fluidic circuit.

In some embodiments, the residual dyes are displaced by a series of packets of novel dyes to produce a striped pattern.

In some embodiments, the docking system contains sensors substantially configured to measure the input and output color of the fluidic circuit.

In some embodiments, the dock would deliver fluid to the fluidic circuit until the color sensor reading at the output valve matched the color sensor reading at the input valve within a desired tolerance.

In some embodiments, the dock contains a plurality of light emitting diodes, filaments, or fluorescent sources to facilitate optical sensing.

In some embodiments, the dock contains disposable color cartridges. In some embodiments, the dock contains a single disposable color cartridge. In some embodiments, the dock contains a multiple disposable color cartridges. In some embodiments, the dock contains red, green, and blue disposable color cartridges. In some embodiments, the dock contains glitter or fluorescent disposable color cartridges.

In some embodiments, the dock communicates with the apparel or equipment. In some embodiments, the communication is facilitated by an EEPROM or RFID tag within the apparel or equipment. In some embodiments, the apparel or equipment communicate to the dock.

In some embodiments, the docking system is comprised of a dock and a user interface. In some embodiments, the user interface is computer controlled. In some embodiments, the user interface is controlled by buttons on the dock.

In some embodiments, the user interface is compatible with metadata describing the parameters of the apparel and equipment. In some embodiments, the metadata is comprised of one or more of three dimensional models of the apparel or equipment, social networking enhanced profiles from users of similar apparel or equipment, shared parameter sets from celebrities, sports figures, authorities, or promotional materials. In some embodiments, the metadata describes a hierarchical assignment of valve priorities to allow coordination of color sets across various apparel or equipment types

BRIEF DESCRIPTION OF THE DRAWINGS

FIG. 1 shows shoe 1001 with two microfluidic circuits 1002 and 1003. FIG. 1A shows the shoe without color within the microfluidic circuit. FIG. 1B demonstrates the results if the first circuit 1002 has been filled with a dark color and circuit 1003 filled with a light color. FIG. 1C shows circuit 1002 filled with a dark color and circuit 1003 filled with a medium luminosity color.

DETAILED DESCRIPTION

Certain embodiments of the present invention relate to the modulation of appearance or material properties within items such as apparel (e.g., footwear, shoes, belts, backpacks, hats, bracelets, wristbands, shirts, jewelry, glasses, materials for apparel, release papers, fibers, etc.), equipment (e.g., skateboards, rollerblades, snowboards, gloves, hockey pads, appliances, computers, electronics, gadgets, toys, etc.), and other three-dimensional objects (signs, corporate art, corporate logos, military vehicles, military gear, helmets, vehicle body panels, housewares, furniture, tabletops, walls, paintings, etc.). In some embodiments, provided herein is an item (e.g., an article of apparel, an article of sporting equipment, or the like) comprising a fluidic channel (e.g., a microfluidic channel containing therein a liquid, particularly a colored liquid). In specific embodiments, the fluidic channel is a part of a fluidic circuit that further comprises an inlet and an outlet, wherein the inlet and the outlet are connected by the fluidic channel. Moreover, some embodiments of the present invention relate to fluidic manipulation of appearance and/or material properties and modulation thereof, including a microfluidic circuit, inlets and outlets to the fluidic system, and a docking system to deliver fluid to the item.

Figure 1:
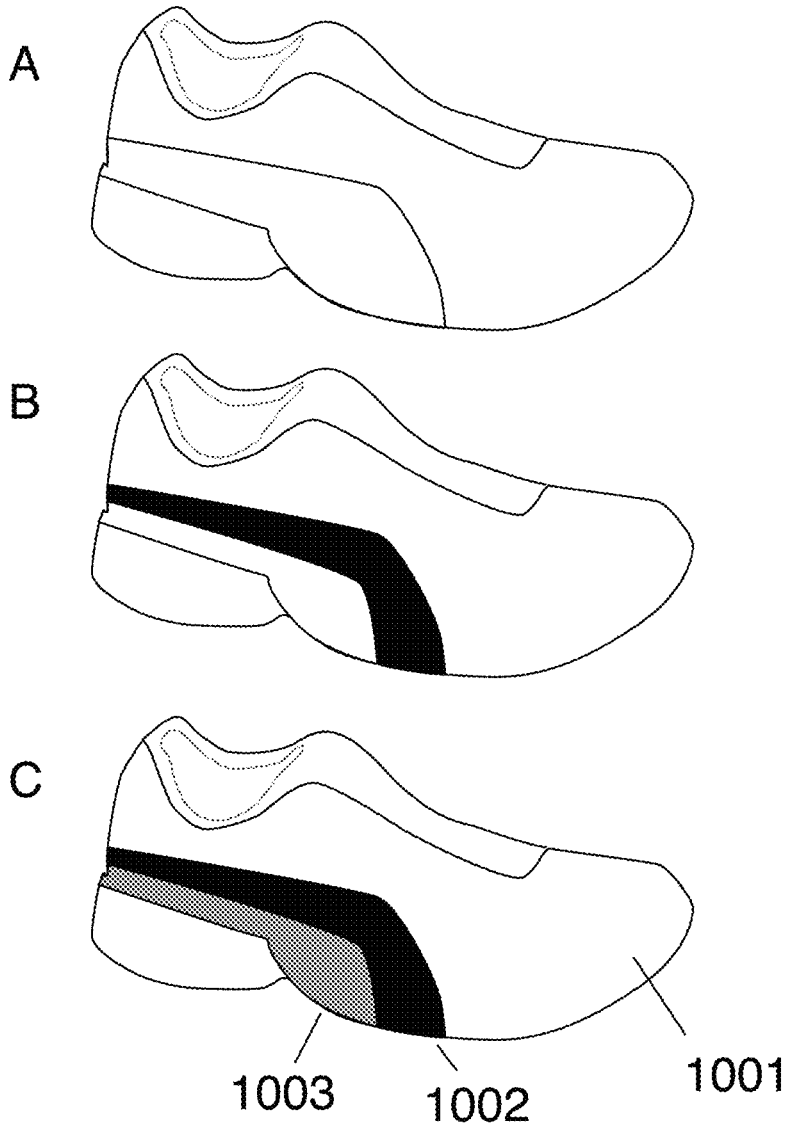
FIG. 1 is one preferred embodiment of the invention.
Figure 2:
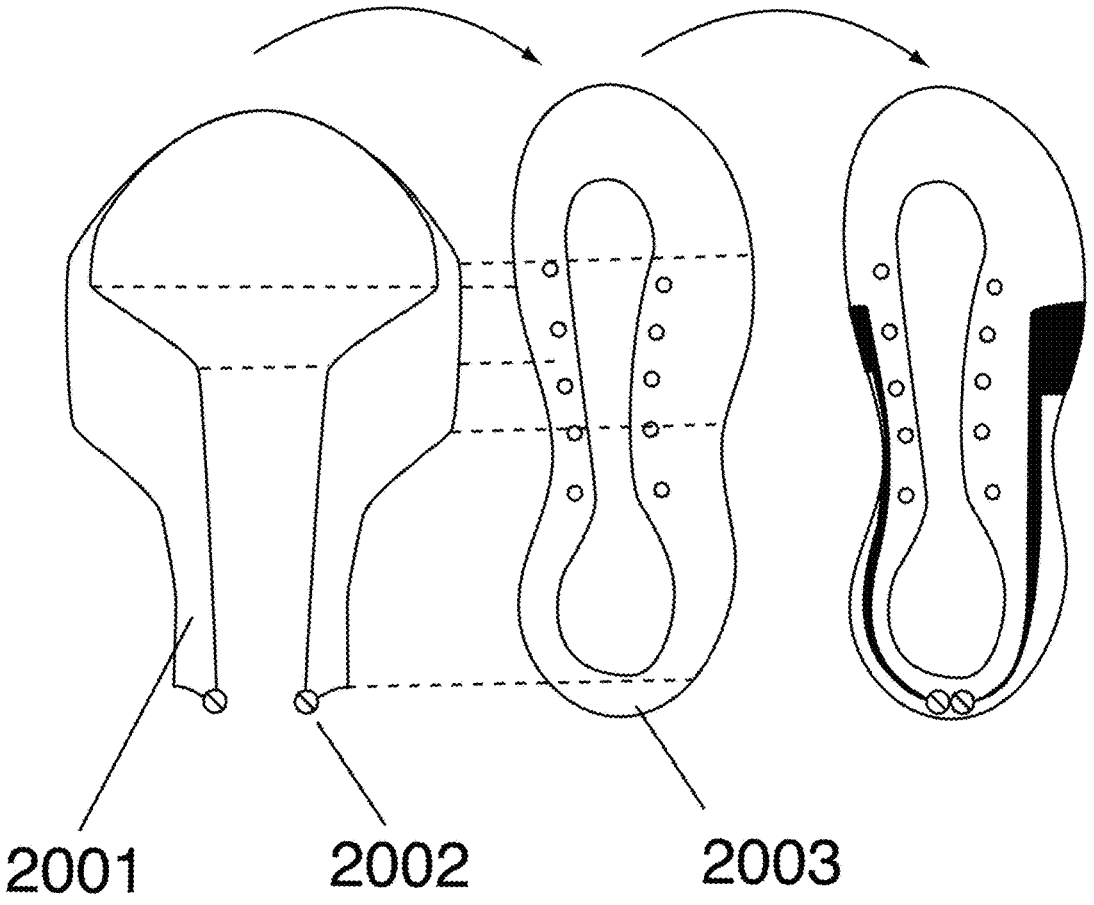
FIG. 2 shows one preferred embodiment of the construction of the shoe. The microfluidic circuit 2001 provides a fluidic path that wraps around the entire shoe. Valve 2002 allows access to the microfluidic circuit. When the microfluidic circuit is fastened to shoe 2003, the valves 2002 can be recessed within the back, heel, sole, or underside of the shoe to be inconspicuous. Moreover, partial extents of the microfluidic circuit can be hidden underneath successive layers of shoe 2003, to help shape the final design elements.
Figure 3:
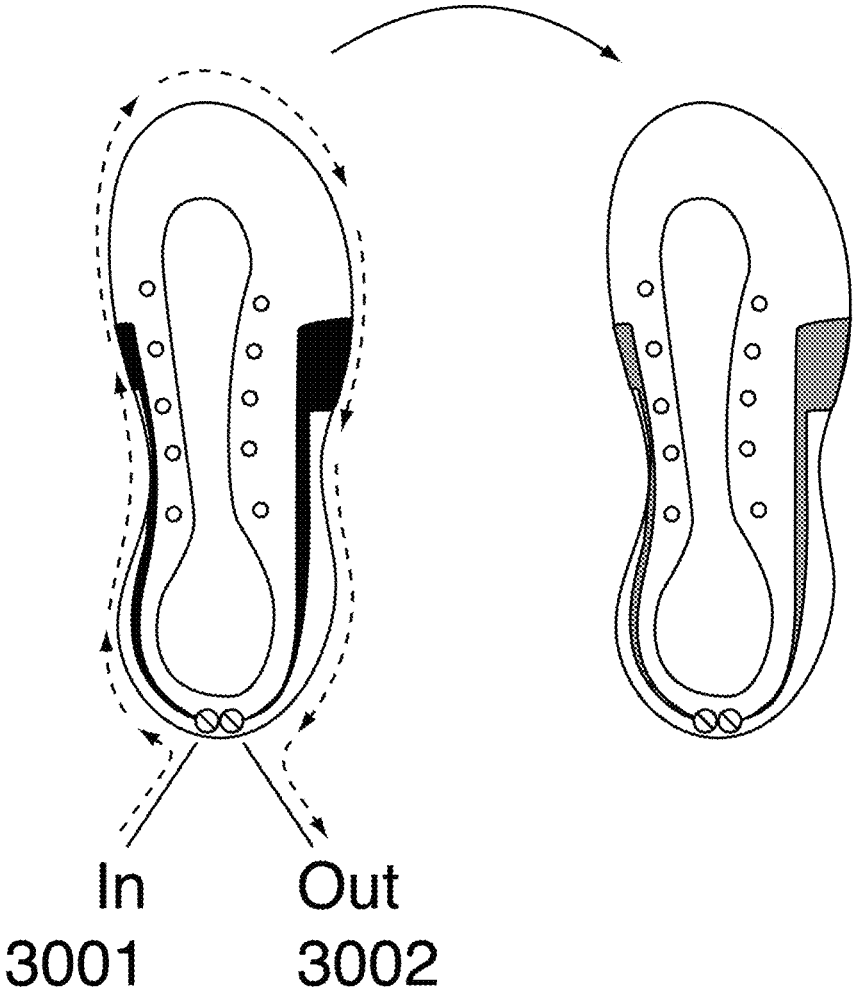
FIG. 3 shows one preferred embodiment of the microfluidic circuit in operation: changing from a dark color to a lighter color. When docked, the inlet valve 3001 and outlet valve 3002 allow lighter colored fluid to displace the darker colored fluid that previously filled the microfluidic circuit. Because certain extents of the circuit are hidden beneath successive layers of the shoe, the user may not see the color move around the toe of the shoe in this embodiment. Air or other spacer fluids can be pumped through the microfluidic circuit to segregate successive colors.

Certain embodiments herein provide an item comprising a microfluidic circuit to allow modulation of appearance or material properties of the item (FIG. 1). One or more microfluidic circuits in the shape of swooshes, stripes, ribbing along the outlines of a design, logos, background elements, etc. can be integrated into an item (FIG. 2). Microfluidic circuits may also encompass a large portion of the item, and in some cases substantially comprise the outer extent of the item; for instance in belts, skateboards, helmets, corporate logos, motorcycle panels, etc. In preferred embodiments provided herein, microfluidic circuits comprise an inlet, an outlet and a translucent or transparent microchannel (i.e., at least a portion of the microchannel is translucent and/or transparent) system, through which fluids can flow (FIG. 3). Microfluidic channel structures (including the fluidic channels and walls between channels) provided herein may cover up to 100%, up to 90%, up to 80%, up to 70%, up to 60%, up to 50%, up to 40%, up to 30%, up to 20%, up to 10%, or up to 5% of an item's surface. Microfluidic channel structures may cover 1-100%, 1-10%, 10-95%, 1-50%, 10-50%, 20-50%, 20-100%, 30-100%, or any other suitable amount of an item's surface.

Provided in certain embodiments herein a design article provided for herein comprises a microfluidic circuit integrated into or onto the surface thereof. In specific embodiments, the microfluidic circuit is integrated into or onto the external surface of the article. In certain embodiment integrated microfluidic circuits or molds comprising microfluidic circuits are attached to an underlying portion of the article surface (e.g., sewn thereto, glued thereto, etc.), or comprise a part of the surface itself (e.g., no underlying surface of the article is necessary). In some embodiments at least one segment (which term is used synonymously herein with a portion of the microfluidic circuit; and is not intended to necessarily denote any substructure of the microfluidic circuit) of the microfluidic circuit (e.g., a wall segment of the microfluidic channel, such as a transparent or translucent wall segment) is exposed to the external surface of the apparel or equipment. Further, in some embodiments, the at least one transparent or translucent wall segment is exposed to the surface of the apparel or equipment, providing for visual contact between the surface of the apparel or equipment and the microfluidic channel (i.e., the fluid, or component parts thereof, can be seen from the exterior of the article). In certain embodiments, up to 100%, up to 90%, up to 80%, up to 70%, up to 60%, up to 50%, up to 40%, up to 30%, up to 20%, up to 10%, or up to 5%, 1-100%, 1-10%, 10-95%, 1-50%, 10-50%, 20-50%, 20-100%, 30-100%, or any other desired amount of the external surface or wall of the microfluidic circuit comprises a translucent or transparent material.

Figure 4:
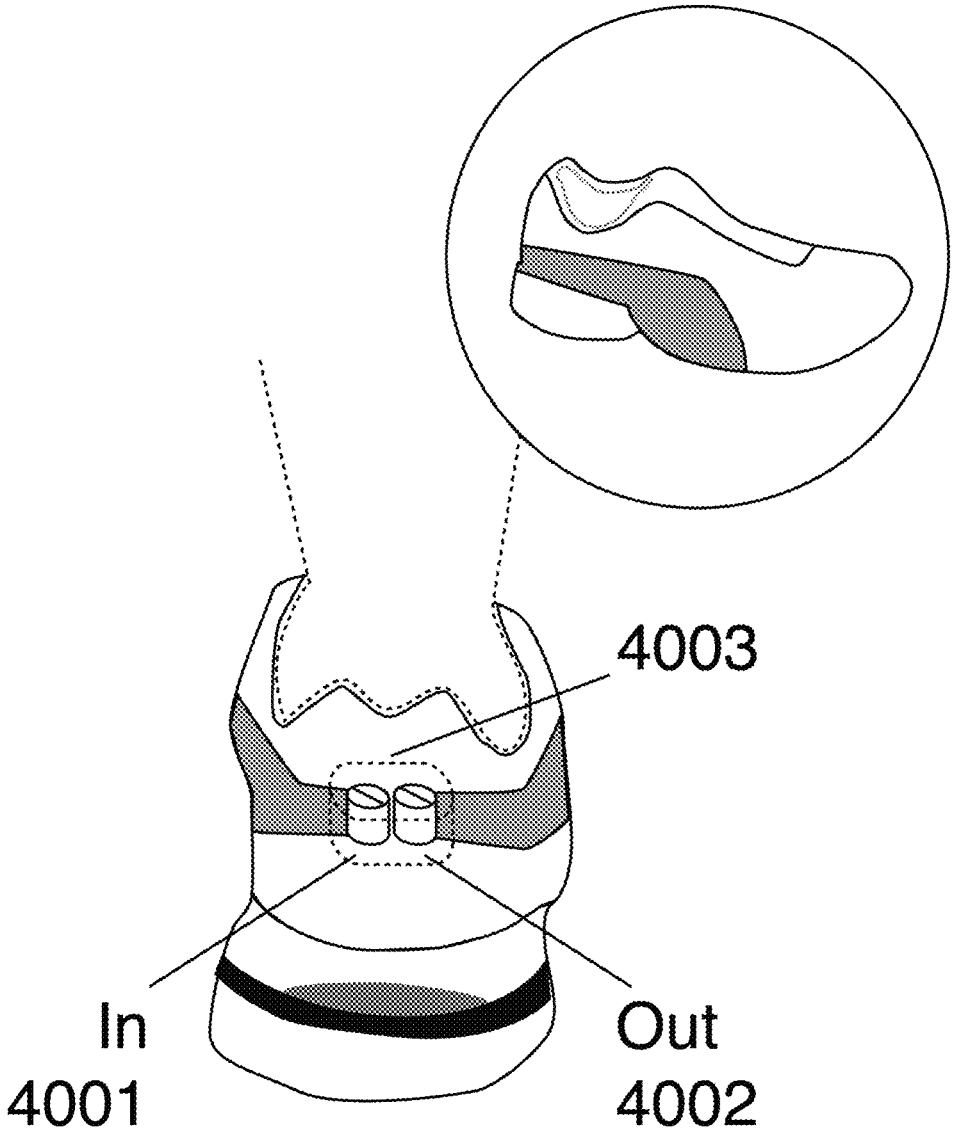
FIG. 4 shows an embodiment of the inlet valve 4001, and the outlet valve 4002 hidden within a recessed port 4003. The port 4003 serves to protect the valves from daily wear and assists in the mechanical coupling to the connector. The shoe in FIG. 4 contains a single microfluidic circuit.
Figure 5:
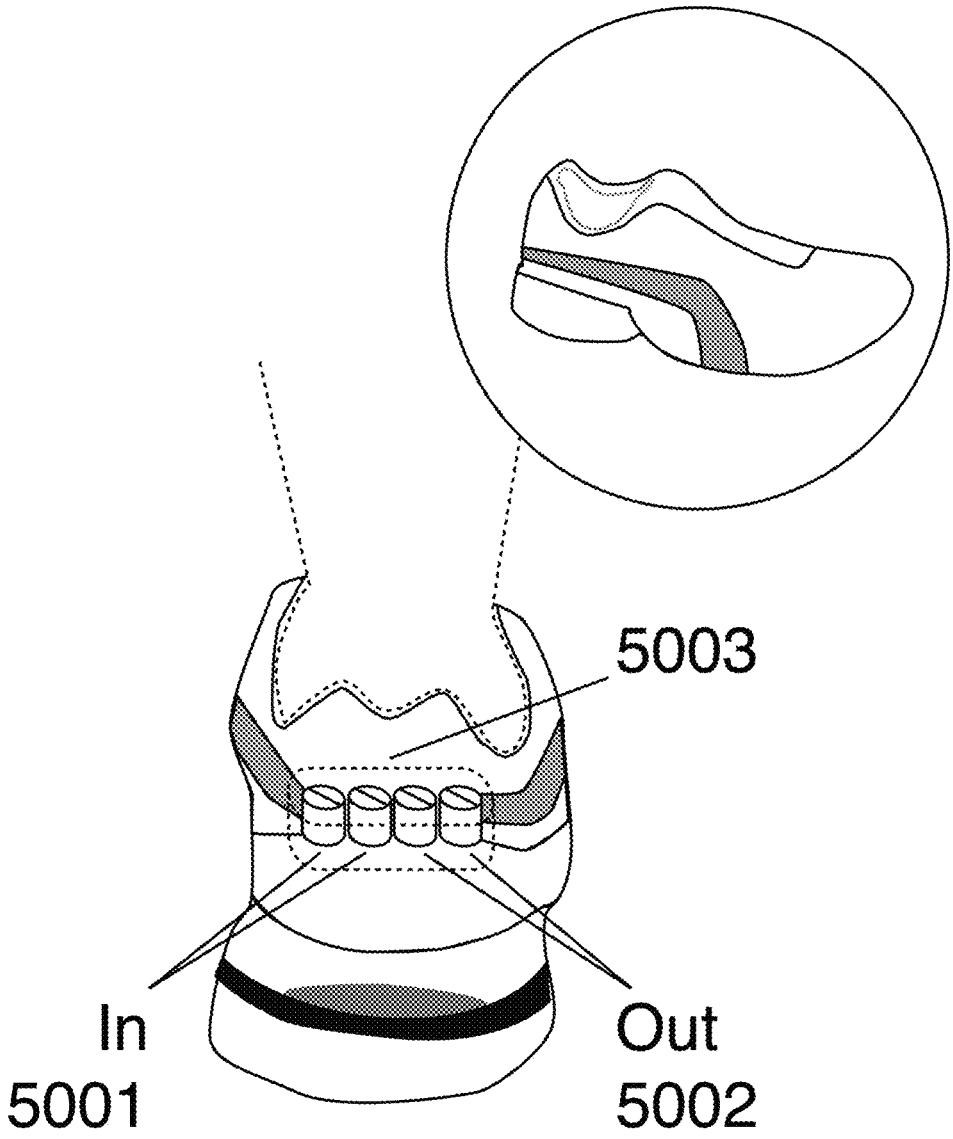
FIG. 5 shows a plurality of inlet valves 5001 and outlet valves 5002 hidden within a recessed port 5003. In this embodiment the shoe contains a plurality of microfluidic circuits to enable independent control of colors within specific extents of the item. In certain embodiments a plurality of microfluidic circuits would converge at low pressure nodes to simplify connections to the item.

The present invention can incorporate a fluidic circuit within the item to allow a user to modulate color within design elements or body of the items (FIG. 2). The fluidic circuit can be comprised of an input valve, output valve and a translucent or transparent circulatory system (e.g., one or more translucent or transparent fluidic channel or microchannel), through which colored dyes can flow (FIG. 3). In certain embodiments the input and output valves can be constructed from septum valves, multi-port valves, check valves, pinch valves, and so forth. In other embodiments, the input and output valves are combined into a single housing. Typically, the valves would be co-located within a connection region of the shoe. In certain embodiments, the valves are protected from wear by housing them in a hard plastic connection region (FIG. 4, FIG. 5). The connection region of the shoe can also be fabricated such that it facilitates simple insertion and alignment to the dock (FIG. 6), through molded guides, ramps, snaps, levers, male/female grooves, etc. The connection region can be recessed within the shoe, for instance hidden within a cutout of the sole of the shoe or within the backing of the heel.

The fluidic circuit of the apparel can be constructed of a transparent plastic such as polymethylmethacrylate, cellulose acetate butyrate, polycarbonate, glycol modified polyethylene terephthalate polydimethylsiloxane, as well as other transparent or translucent plastics suitable for apparel. The circulatory system can be comprised of a rigid, semi-rigid molded part, or in other embodiments, flexible vacuum molded parts. The lumen of the fluidic circuit could be formed from outer shoe fabric and the transparent plastic. In other embodiments, the lumen of the fluidic channel is formed between a backing material and the transparent plastic. In these embodiments, the backing material is fastened to the outer shoe through an adhesives process or sewn to the shoe around the edges or certain attachment points of the circuit. In other embodiments, either the backing material is reflective, or a third layer reflective layer such as biaxially-oriented polyethylene terphthalate (mylar) is included between the backing material and transparent plastic. In yet another embodiment, the surfaces comprising the lumen of the fluidic channel are modified, treated, or coated to reduce adhesion to, adsorption from, or staining by the dyes used to modulate colors. These treatments and material selections include rendering the lumen hydrophilic for a hydrophobic dye, hydrophobic for hydrophilic dyes, charged for nonpolar dyes, as well as selecting the dyes and lumen to be both hydrophilic or hydrophobic. These treatments may also serve to reduce evaporation through the polymeric structure of the fluidic circuit. Although these embodiments maximize the modulation of reflected light, they are not exclusive from design elements that include the use of transmitted light from piezoelectric or battery driven LEDs. In other embodiments, the capability to modulate design elements is self-contained within the apparel, i.e., through the use of an electronic ink (i.e., liquid crystal, nano-ink, e-ink, nanoparticle suspensions, etc.) with the appropriate electronic or wireless connections to the user interface. In some of such embodiments, the design circuit of the article does not require an inlet and outlet valve.

Figure 7:
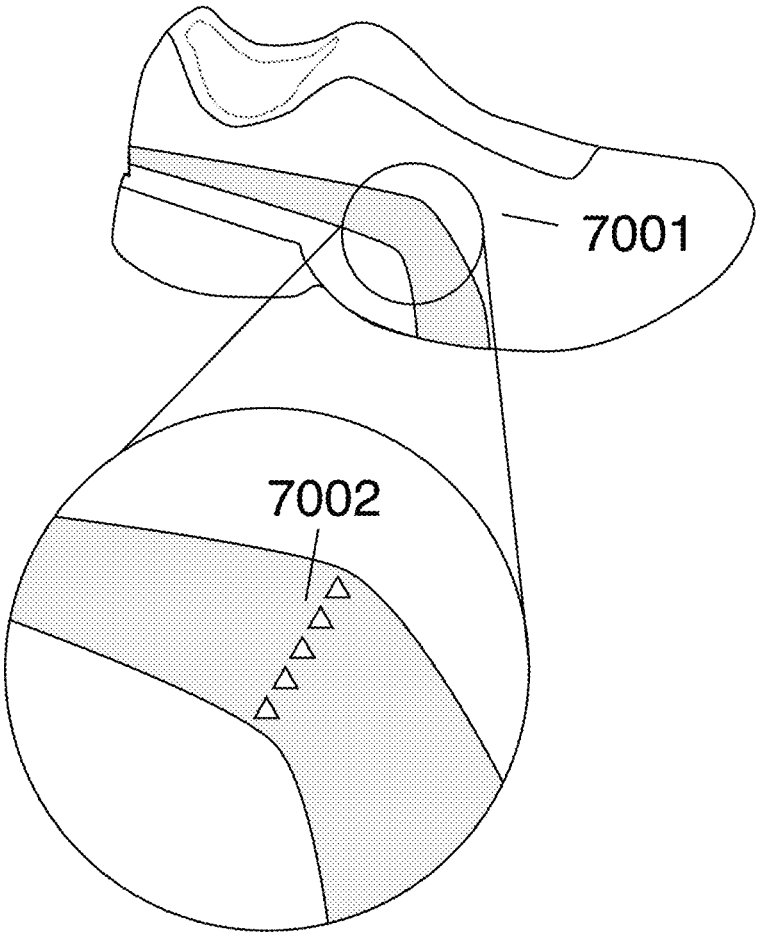
FIG. 7 shows an example of a microfluidic circuit 7001 with a mixer 7002 to facilitate homogeneous distribution of fluid within the microfluidic circuit.
Figure 8:
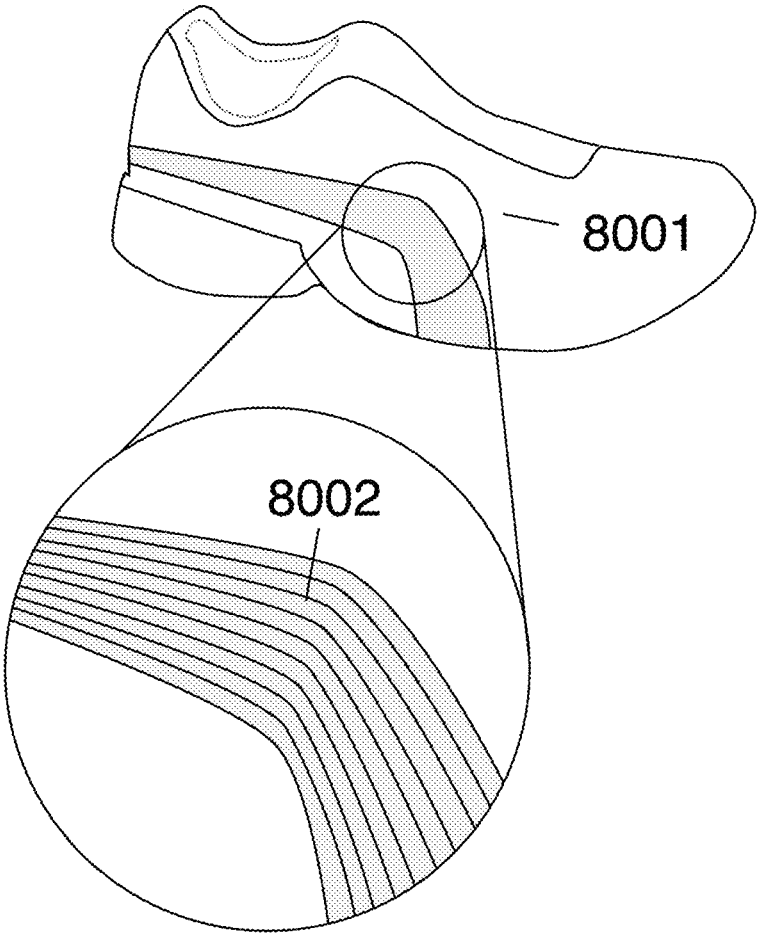
FIG. 8 shows an example of a microfluidic circuit 8001 consisting of a plurality of microfluidic channels. In certain embodiments, each channel could be constructed of a semi-circular cross-section to act as a lens. In certain embodiments, the flat underside of the microfluidic circuit closest to the shoe could contain a reflective layer to enhance the visible color.

The volume of the fluidic system would be preferentially minimized to drive the economics of the apparel while retaining sufficient color density to be aesthetically pleasing. In certain embodiments, this would translate into a very thin vertical extent of the circuit, on the order of 50-1,000 μm. In other embodiments, the vertical extent of the circuit would be on the order of 100-200 μm. In other embodiments, the vertical extent would be such that the Reynolds number would be much less than 2,300, classifying the channels as microfluidic, through which the flow becomes laminar. In other embodiments, the fluidic channels are configured to promote plug flow, in order to eliminate boundary layers adjacent to the walls of the fluidic channel. In certain microfluidic embodiments, mechanical features of the design elements promote mixing as dyes are pumped through the fluidic circuit (FIG. 7). In other embodiments, each design element would be comprised of a plurality of microfluidic channels to eliminate the need for mixing (FIG. 8). In a preferred embodiment, the plurality of microfluidic channels act independently as microlenses to amplify the color contained within the design element. Design elements include shapes such as swooshes, bars, stripes, stars, the toepiece, shoelace holes, or even the majority of the outer face of a shoe.

In some embodiments, mixing of colors to provide a specialized and tuned color by a user is desirable. Mixing of inks may occur in any suitable location including, e.g., in the fluidic channels of the article and/or in the fluidic docking station. In certain microfluidic embodiments, mixing within the laminar fluidic circuit can be comprised of flow splitting, hydrodynamic focusing, capillary flow splitting and recombination, flow twisting, chaotic advection, surface acoustic waves, diffusion, grooves, modulated pumping schema, and other methods known to those skilled in the art of mixing within microfluidic channels. In other embodiments, a mixing element is contained within the dock prior to exposure to the fluidic circuit on the apparel. In other embodiments, users may mix their own colors using home kits for injection into the apparel.

Modulation of the color of design elements is preferentially achieved by thoroughly replacing the resident dyes within the fluidic channel with novel colors of dye. In one preferred embodiment, the fluidic channel is thoroughly flushed with a carrier fluid before introduction of a new dye. Said carrier fluid can be preferentially comprised of a transparent solvent, water, aqueous solutions, ethanol, glycerols, polyethylene glycols, and so forth. In certain embodiments, the dock contains a waste reservoir to collect residual dye and carrier fluid.

Flushing could be achieved through various amplitudes of pressure, time, electric field transport (including electrophoretic, electroosmotic, dielectrophoretic, electrothermal flow, etc.), or agitation. In certain embodiments, the design of the fluidic circuit would work in concert with the application of pressure to maximize the hydrodynamic entrance length, on the order of upwards of 50-100 channel widths.

The dock would preferentially contain the actuation elements corresponding to the particular flow modality: electrodes for electric field mobility, pumps for pressure based flow (including peristaltic, positive displacement, rotary pumps, and so forth).

In other embodiments, no carrier fluid would be used to flush the resident dye. Flush-free embodiments include displacing the entire volume of resident dye through plug flow. In yet another embodiment, the novel dye would flow through the fluidic circuit down the central lumen of portions of the circuit using fully developed Poiseuille flow, facilitating replacement of the resident dye through simple diffusion or mixing dynamics inherent within the fluidic circuit. In yet another embodiment, a bolus of immiscible fluid could precede the new dye to facilitate replacement of the resident dye without mixing. The immiscible fluid could be comprised of a fluid with sufficient density to substantially alter its flow profile throughout the fluidic circuit. In yet other embodiments, design elements could be filled with a series of fluid packets (volumes of fluid less than that of the entire design element lumen) to produce multiply colored or striped elements.

In order to accommodate items and design elements of different volumes, the dock mechanism may include sensors substantially configured to measure the input and output color of the fluidic circuit. In certain embodiments, the circuit would flow until the sensors detected color at the output valve would match the input valve to a desired tolerance. In other embodiments, the circuit would flow until the color at the output valve matched a preselected color to a desired tolerance. Incorporation of a sensor network within the dock allows the fluid transfer interface to be guided by a control system (PID, PI, negative feedback, and so forth) to regulate pressures within operable limits. The dock may include a variety of types of sensors, including flow sensors, pressure sensors, and optical sensors. In the embodiment of optical sensors, the dock may further comprise a light source to illuminate the dye within the fluidic circuit to enable facilitate optical sensing; for instance, through the use of a plurality of light emitting diodes, filaments, or fluorescent sources. The dock may also be comprised of ultrasonic sensors to detect flow.

In certain embodiments, the user interface can be running on a computer connected to the docking station (through USB, 802.1 Il wireless, bluetooth, infrared, internet, iPhone, etc.) wherein the interface allows the user to control the color of individual compartments of the apparel. Color selections can be made through an on-screen color wheel, eyedropper tool to sample a color from a picture of an outfit uploaded to the screen via camera, phone, internet, etc., or through parameters downloaded and shared through a web-interface that allows social networking with friends to coordinate apparel colors for that day. In one embodiment, the userselected colors will be translated into appropriate amounts of red, green, and blue dyes housed in the dock. In other embodiments, specialized dyes Provided in further embodiments herein is a method of manufacturing an article of apparel or equipment having alterable design features, the method comprising:

integrating a microfluidic circuit into or onto the surface of the article, the microfluidic circuit comprising a microfluidic channel, an inlet and an outlet, and the microfluidic channel having at least one segment in visual contact with an external surface of the article.

In some embodiments, provided herein is a method of modulating the appearance or material properties of an article of apparel or equipment comprising:

moving fluid through a microfluidic circuit integrated with the apparel or equipment and having at least one segment in visual contact with an external surface of the apparel or equipment, the microfluidic circuit comprising a microfluidic channel, an inlet and an outlet, with the microfluidic channel connecting the inlet to the outlet within the article.

In a first embodiment, one or a plurality of microfluidic circuit(s) are integrated into the exterior of an item of footwear. In one embodiment, the inlet and outlet of the microfluidic circuit are contained within a port hidden within the back heel of the shoe. In such an example, connection to the docking station allows the user to change the color of the exterior of the shoe to match the desired color. In certain embodiments, the microfluidic circuits are configured to cover 75% of the exterior of the shoe, for instance the channels can be integrated into the synthetic leather upper, the tongue of the shoe, and the sole. In other embodiments, the microfluidic circuits are configured to cover 25% of the exterior of the shoe, for instance against a white leather shoe, the microfluidic circuits comprise the stylized logos and decorative ribbing alongside the circumference of the shoe. In yet other embodiments, the microfluidic circuits are configured to comprise 100% of the upper exterior of the shoe, having been integrated directly into the polyurethane or polyvinyl chloride release papers that then form the pad and the strap of a high heel shoe. In yet another embodiment, the microfluidic circuits are fashioned into 10% of the exterior of the shoe, molded to cover the straps on a pair of sandals. In another embodiment, the microfluidic circuits are integrated into the substructure of a shoe, covered by a porous material, such as a canvas or cotton to allow color to be seen through the gaps of the material. In yet other embodiments, combinations of microfluidic circuits offer multiple ways to expressing oneself, e.g., stiff polycarbonate microfluidic circuits prominently displayed on 50% of the exterior of the shoe with another 15% of the shoe covered in a soft polyurethane microfluidic circuit that covers the toe box and circumvents the shoelace holes. In certain embodiments, the microfluidic circuits are fabricated from polyurethane. In others, the microfluidic circuits are fabricated from polyvinyl chloride, poromerics, pleathers, Clarino, polycarbonate, or other synthetic leather materials.

In addition to the appearance of an item, the microfluidic circuit may also transport various fluids throughout the extent of the item to modulate the material properties of the item. For instance, in addition to the appearance, exchange of fluids within the microfluidic circuit may modulate the touch, feel, stiffness, or roughness of the item. In one embodiment, a metal microparticle sol may optionally displace an aqueous suspension of small molecule dyes to randomly distend a soft microfluidic circuit (for instance, made of lightly crosslinked polyurethane), which would simultaneously create raised reflective bumps along the skin of the item in place of the previous smooth, homogeneous and brightly colored surface. In another embodiment, a purple, heated, lavender scented polyethylene glycol solution with a large heat capacity is optionally pumped through the base of a shoe to displace a cold metal microparticle solution in order to modulate the thermal properties and rigidity of the shoe. In yet another embodiment, microfluidic circuits are molded into an article of clothing for a toy doll, in which a color (e.g., bright green) is optionally replaced by a magnetic glitter, that allows other magnetic components to be attached to the toy's apparel.

Other material properties that may be altered by transport through the microfluidic circuit include optical properties (e.g., color, reflectivity, absorption), scent, thermal properties (e.g., heat capacity, heat transfer coefficient), mechanical properties (e.g., stiffness, roughness, pressure), electromagnetic properties (e.g., paramagnetic, ferromagnetic, conductive), therapeutic properties, or chemical properties (e.g., fluorescent, chemiluminescent) of the item.

Valves Between Connector & Item

In certain embodiments the openings (e.g., inlets to and/or outlets from) the microfluidic circuit contain valves. In such embodiments, input and output valves can be constructed from septum valves, check valves, ball valves, multi-port valves, microfluidic valves, pinch valves, and so forth. In one preferred embodiment, microfluidic circuit valves are comprised of a polyphenylenesulphone (PPSU), nitrile butadiene rubber (NBR), and polyimide (PI) passive dynamic check valve. In various embodiments, the valve may have any suitable dimension, e.g., roughly 2×0.5 mm in dimension. Further, in various embodiments, the valve may have any suitable structure and/or connection to the fluidic channel, e.g., be embedded within a stainless steel tube of roughly 2×17 mm with an internal volume of 2-5 nL. Valves used in the circuits described herein may deliver any suitable volume of fluid to the circuit. For example, in an embodiment, such as described above, a preferred valve may deliver 0.10-0.30 mL/s at a forward pressure of 7.25 psi. In certain embodiments, the normally closed valves are optionally coupled with a filter. In other embodiments, one or each valve is optionally a normally closed solenoid valve that is actuated by electrical signals carried by the connector to allow flow to various design elements on the item. In such an embodiment, one fluid line from the docking station is optionally split into a plurality of microfluidic circuits within the port of the item, and flow to each design element mediated by the aforementioned active valves.

Figure 6:
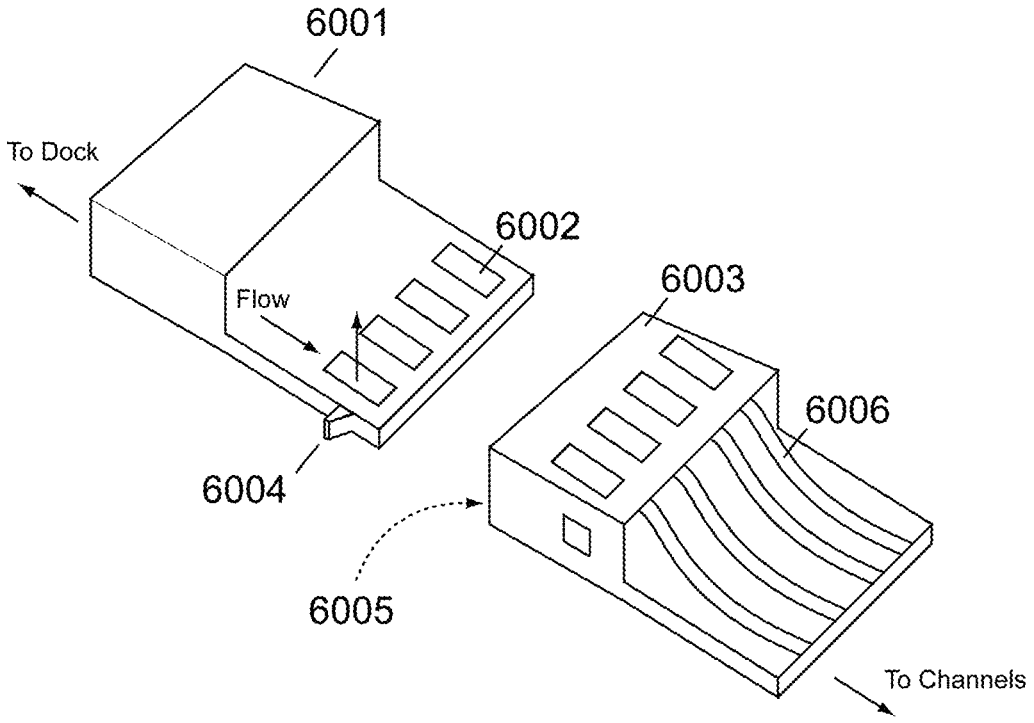
FIG. 6 shows an example of a connector 6001 structure with a plurality of inlets and outlets 6002 that are integrated into a single manifold. The connector slides into the port 6003. The two pieces snap into place via a male/female locking mechanism 6004. The mating of the connector to the port pushes back a spring-mounted seal 6005 that opens the circuit on the port side 6006. The seal also provides sufficient pressure on the connector to facilitate a leak-free fluidic connection between the channels on the two sides. The connector may have an additional seal on top of the manifold to assist in preventing leaks. The connector may also carry electrical signals to allow feedback upon connection.

In certain embodiments, the valves are optionally protected from wear by housing them in a port, e.g., a protective port, such as a hard plastic port (FIG. 4, FIG. 5). The port is optionally recessed within a shoe, for instance, hidden within a cutout of the sole, within the backing of the heel, or any other suitable location. The port can also be fabricated such that it facilitates simple insertion and alignment to the docking station connector, through molded guides, ramps, snaps, levers, male/female grooves, etc. FIG. 6 demonstrates an example of a connector that simultaneously interfaces to, and opens, the microfluidic circuit valves. In embodiments that use check valves, the increase in pressure from the docking station would open the valves in the item. Other embodiments that use simple septum valves would use a connector with pins that would push past the seal and enter the fluid lines in the item.

Materials & Construction of Microfluidic Circuits

The microfluidic circuit of the items described herein (e.g., apparel) can be constructed of any suitable material. In certain embodiments, the structure of the microfluidic circuit or microfluidic channel comprises void (containing a fluid, or into which a fluid may flow) enclosed (e.g., with walls, with at least one opening) by any suitable material or combination of materials. In some embodiments, the microfluidic circuit or channel is constructed of (wholly or in part) a transparent plastic such as polyurethane, polyvinyl chloride, polymethylmethacrylate, cellulose acetate butyrate, polycarbonate, glycol modified polyethylene terphthalate, polydimethylsiloxane, as well as other transparent or translucent plastics suitable for apparel and/or sporting equipment. The microfluidic circuit can be comprised of a rigid, semi-rigid molded part, or in other embodiments, flexible molded parts. In one embodiment of a mold & seal process, two halves of the microfluidic circuit are injection molded and partially cross-linked, prior to alignment and sealing. Alignment of the two halves can be facilitated by the use of automated jigging that moves partially cured items from the molding machine into place, holds a top piece using vacuum pressure, then presses the two halves into one. In various embodiments, sealing comprises and/or is achieved via the use of pressure, heating, acid, UV light exposure, UV-ozone exposure, waiting to allow the partially cross-linked halves to bind to each other as polymerization reactions move towards completion, or the like. In other embodiments, sealing comprises application of an adhesive (chemical adhesive, multi-part epoxy, light-curable compounds, or soaking in acid etc.) between the two layers before applying pressure, heat, UV light exposure or time. Other methods of construction optionally include a process where a positive molding of a channel lumen is constructed using a soluble solid (either water soluble like sugars, starches, cellulose, etc., or soluble in an gentle organic solvent that will not perturb the two halves of the circuit), and is then placed in the polymer mold. In some of such embodiments, upon filling the mold and fully curing the circuit, the assembly is soaked in solvent to remove the channel lumen mold, or solvent is pumped through the circuit to dissolve the positive mold.

In some embodiments, a design feature or design mold comprises a plurality of microfluidic channels and/or microfluidic circuits. In certain embodiments, such a design feature or a design mold comprises a stitching or attachment portion for attachment to another design feature or design mold, or other material. In some instances, a stitching portion may include, e.g., a portion devoid of microfluidic channels, or of microfluidic channels that are sealed, or otherwise not connected or capable of being connected to a fluid source. In some instances, one or more microfluidic circuits may be molded such that a small outer rim of material is built into the circuit, such that the rim is sufficiently wide to allow stitching or adhesion onto the item's exterior. In various embodiments, the stitching or attachment portion, or rim, is of any size suitable for assembling an article described herein. For example, the rim would be preferably no more than 5 mm wide. In other embodiments, the rim would be on the order of 30 mm wide, which would be useful in cases where the outer rim of the microfluidic circuit is to be pulled over the last of a shoe during manufacturing. In other embodiments, design features, design molds, or other assemblies of microfluidic circuit(s) do not comprise and/or do not need such stitching/attachment portions or rims because they are attached in another suitable manner. For example, microfluidic circuits may also be attached to the item and/or fabricated into the item using an adhesive, epoxy, etc.

In other embodiments, the microfluidic circuit(s) (e.g., design mold) may be fashioned from a single layer of transparent plastic containing embedded channels sealed directly to the surface of the item, e.g., in the case of a skateboard or snowboard deck. In some embodiments, this type of construction is suitable for use in equipment where a thick layer of adhesive can be applied to the item and the channels pressed on top of the adhesive.

In other embodiments, the microfluidic channel/circuit construct (e.g., design mold) incorporates a backing material attached to a transparent/translucent material (e.g., plastic). In such embodiments, the backing material can be fastened to the item through an adhesives process or sewn to the item around the edges or at designated attachment points. In such embodiments, the backing material may supply additional optical characteristics such as a reflective surface (e.g., using bixially-oriented polyethylene terphthalate), or an opaque white background (e.g., polyethylene).

In yet another embodiment, the surfaces comprising the lumen, exposed, or transparent portion of the fluidic channel/circuit construct are modified, treated, or coated to reduce adhesion to, adsorption from, or staining by the dyes used to modulate colors. These treatments and material selections include rendering the lumen hydrophilic for a hydrophobic dye, hydrophobic for hydrophilic dyes, charged for nonpolar dyes, as well as selecting the dyes and lumen to be both hydrophilic or hydrophobic. These treatments may also serve to reduce evaporation through the polymeric structure of the microfluidic circuit by laminating, coating, or otherwise sealing the exterior of the plastic.

In some instances, microfluidic circuit embodiments are intended to maximize reflected light to create the most vibrant color changing apparel and equipment, and in other instances, microfluidic circuit embodiments diffuse and distort light, including patterned surface textures made to specular light patterns consistent with the texture of leather, or prismatic embossments for adding sparkle to the surface, or a microlensed surface for a distorted effect. Other embodiments of microfluidic circuits incorporate the use of transmitted light from piezoelectric or battery driven LEDs. In other embodiments, the capability to modulate color is assisted through the use of an active element such as liquid crystals, nano-inks, e-inks, OLEDs, LEDs, or nanoparticle suspensions, etc.

Microfluidic Circuits

Fluidic circuits of the systems described herein comprise channels having any suitable dimensions, including, lengths, depths, diameters, geometries, etc. In various embodiments, the internal channels of the fluidic circuits are circular, square, oval, pyramidal, triangular, etc. In some embodiments, the internal diameters of the channels are any channel suitable to provide a desired design feature when filled with a liquid (e.g., a colored liquid). In specific embodiments, the internal diameter of a channel provided herein is small enough so as to minimize mixing and diffusion along the fluidic channel. In certain embodiments, the dimension (e.g., depth, width or diameter) of a fluidic or microfluidic channel described herein is at least 0.1 micron, of 0.1 micron to 10 mm, of 0.1 micron to 1 mm, of 0.1 micron to 100 mm, of 1 micron to 1 mm, of 1 micron to 500 micron, of 10 micron to 1 mm, of 10 micron to 0.5 mm, of 50 micron to 500 micron, or any other suitable diameter. Further, in various embodiments, different channel segments along a fluidic circuit may also possess varying dimensions (e.g., at one point along the fluidic circuit, the diameter may be 10 microns, whereas at other locations along the circuit, the diameter may be 20 microns, or the like).

Further, in various embodiments, the walls of the fluidic circuit (i.e., surrounding the fluidic channel) are of any suitable thickness. In some embodiments, the walls between microfluidic channels of a system described herein are narrower than the walls forming the surface and/or back constructs of the microfluidic channel. In some embodiments, wall widths between parallel channels of 1 micron to 10 mm, or 10 microns to 1 mm, 50 microns to 1 mm, 50 microns to 500 microns, 50 microns to 250 microns, 100 microns to 500 microns, 200 microns to 500 microns, 300 microns, 400 microns, or the like.

The volume of the fluidic system would be preferentially minimized to drive the economics of the application while retaining sufficient color density to be aesthetically pleasing. In certain embodiments, this would translate into a very thin channel depth of the circuit, on the order of 10-1,000 μm. In other embodiments, the channel depth of the circuit would be on the order of 300-700 μm. In other embodiments, the vertical extent would be such that the Reynolds number would be much less than 2,300. In other embodiments, the fluidic channels are configured to promote plug flow, in order to eliminate boundary layers adjacent to the walls of the fluidic channel (Acis, Rutherford. *Vectors, Tensors, and the Basic Equations of Fluid Mechanics*. New York: Dover Publications, Inc., 1962; Panton, Ronald L. Incompressible Flow, Second Edition. New York: John Wiley & Sons, Inc. 1996, which are incorporated herein for such disclosure). In certain microfluidic embodiments, mechanical features of the design elements promote mixing, as dyes are pumped through the microfluidic circuit (FIG. 7), these include, e.g., any suitable microfluidic mixing mechanisms such as grooved channels, Tesla mixers, T- and Y-flow configurations, interdigital/bifurcation flow distribution structures, focusing structures for flow compression, repeated flow division- and recombination structures, flow obstacles, zigzag channels, and other passive micromixing designs or microvalving designs. In other embodiments, each microfluidic circuit comprises a plurality (one or more) of channels that carry an independent color or color series (FIG. 8). Examples of microfluidic circuit designs include shapes such as swooshes, bars, stripes, stars, toe pieces, shoelace holes, or even the majority of the outer face of a shoe. Microfluidic circuits can also comprise the entire outer extent of a three-dimensional item. For instance, the panels of a backpack, the outer section of a belt, the lettering within a corporate logo, the outer plastic shell of a rollerblade, or an identification panel on a military vehicle (that could communicate through a combination of infrared dyes or nanoparticles, for instance). Microfluidic circuits can also be made to be as simple as single tubes fashioned into as stripes on backpacks, hats, the rim of a shoe, or other apparel and equipment.

Figure 9:
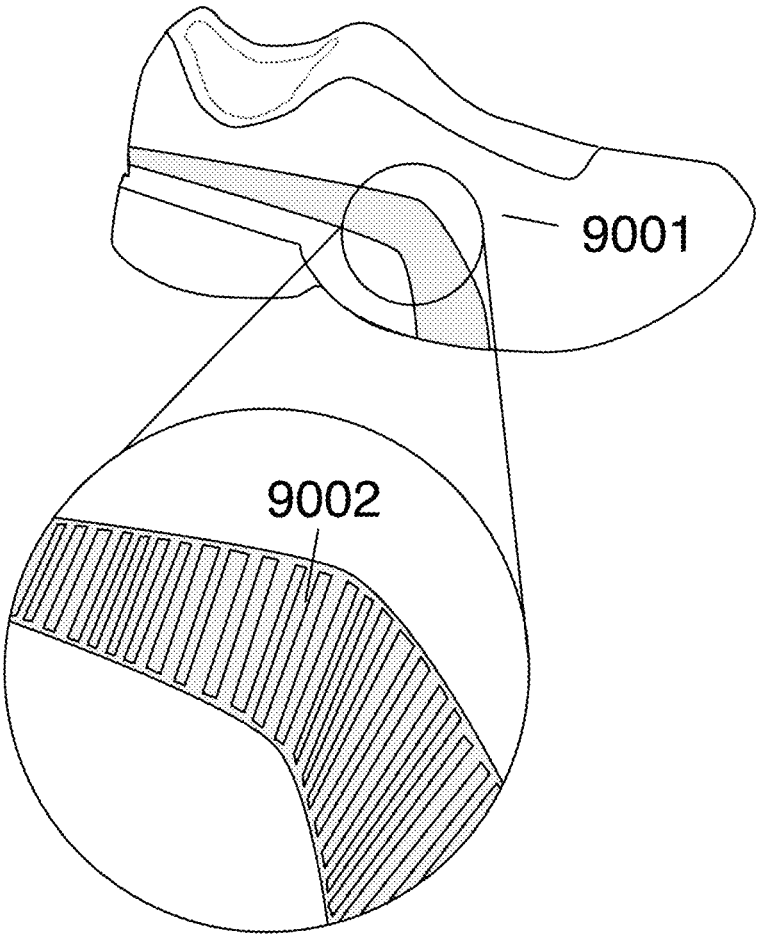
FIG. 9 shows an example of a microfluidic circuit 9001 with a single serpentine channel 9002. The serpentine channel widths would be roughly 0.35-1.05 mm, while the inter-channel (wall) spacing would be on the order of 0.40-0.45 mm.
Figure 10:
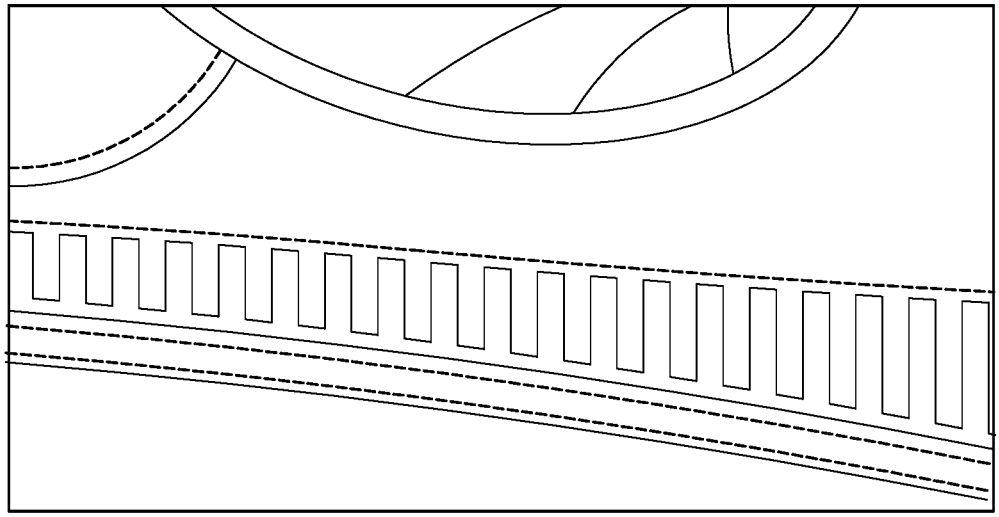
FIG. 10 shows a reduction to practice of a microfluidic circuit with a single serpentine channel integrated into a shoe. When viewed up close, individual turns of the serpentine channel are visible. When viewed from afar, the color of the microfluidic circuit appears continuous.
Figure 10:
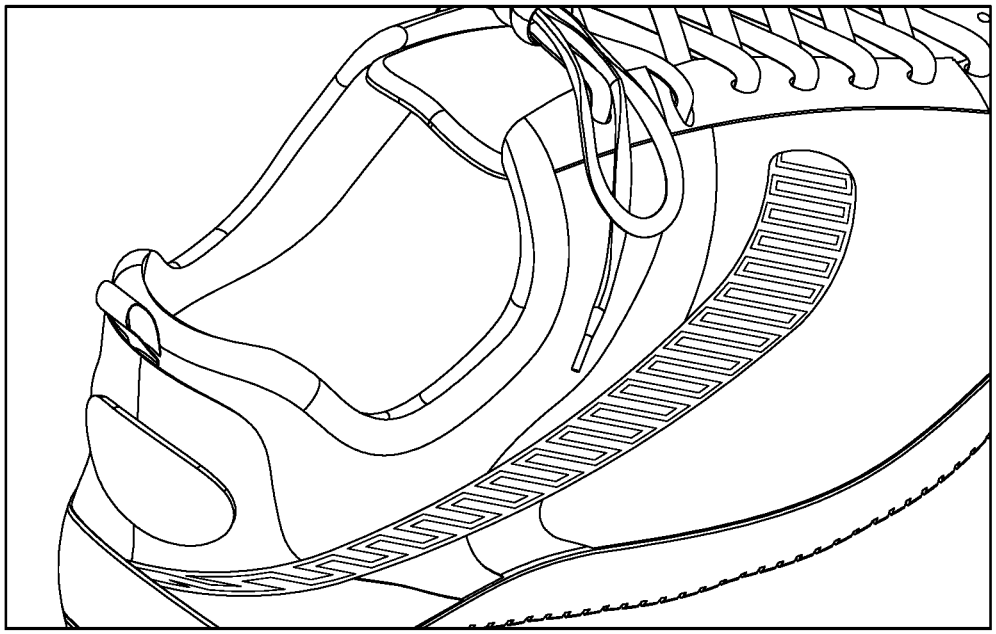

In a preferred embodiment, a single serpentine channel is woven throughout each design element to eliminate voids in higher pressure paths (FIG. 9). Optimal channel widths can vary between 0.05 mm-5 mm, with spacing between parallel channels of 0.05-1 mm (wall widths). In one exemplary embodiment, the channel wall width would is from 0.40 mm to 0.45 mm, while channel widths optionally vary between 0.35 mm and 1.05 mm depending on the portion of the serpentine path. In such an embodiment, with channel depths of approximately 0.5 mm and a total channel path length on the order of 2,500 mm, the a filling volume would be 500-600 μL (0.5-0.6 mL) and the filling time would be roughly 64 seconds at 3.2 PSI. In yet another exemplary embodiment, the minimum channel wall width would be 0.1 mm, with a maximum channel wall width of 0.65 mm, while channel widths would change between 0.35 mm and 1.25 mm depending on the portion of the serpentine path. In such an embodiment, with channel depths of approximately 0.5 mm, the total channel path length on the order to 2,000 mm, the filling volume would be 400-500 μL (0.4-0.5 mL) and the filling time roughly 15 seconds at 12 PSI. Larger channel cross sections, shorter path lengths and higher filling pressures would lead to shorter filling times. FIG. 10 demonstrates a reduction to practice of the serpentine channel concept on a shoe.

Docking Station Configurations

Figure 11:
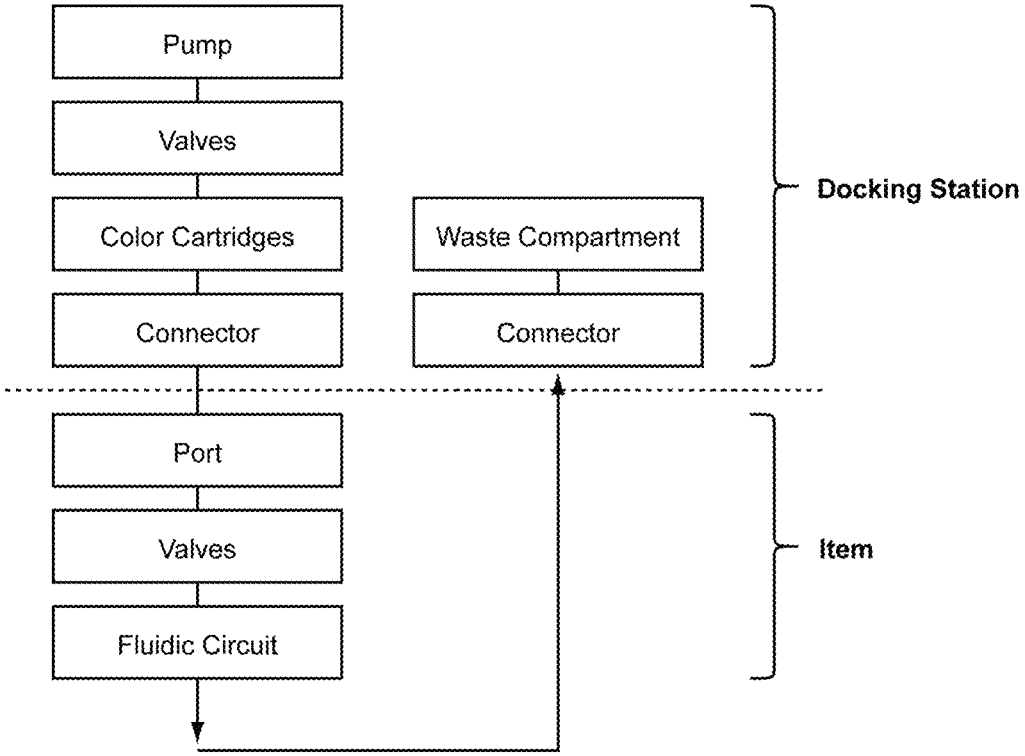
FIG. 11 is an example of a basic dock configuration, with one master pump and a plurality of valves. In this configuration, the valves inside of the docking station change the resistance to flow of each line, in order to modulate the fluid that is pushed through the circuit. This configuration would lend itself to pneumatic valves. When connected, the pressure generated in the docking station opens the check valves in the item, which allows fluid flow to progress throughout the extent of the item, returning into the docking station to be collected in the waste compartment. The waste compartment may be open to the air to allow for evaporation, or can be removed by the user to allow for routine disposal.
Figure 12:
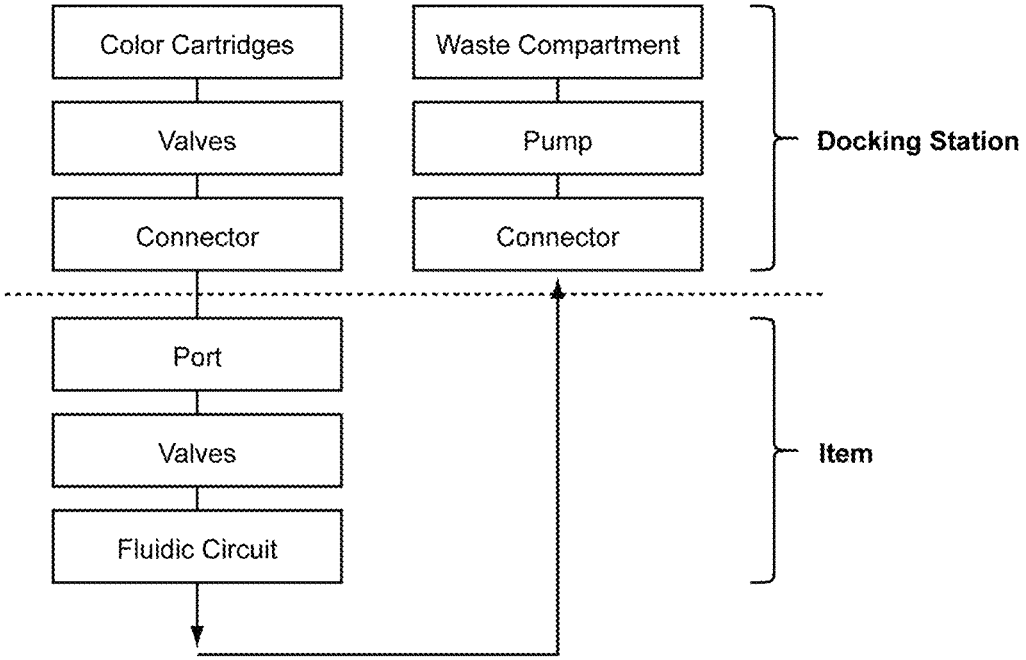
FIG. 12 is an example of a dock configuration with one master pump that pulls the fluid through the circuit. Actuation valves change the resistance of the fluid lines to modulate the level of each type of fluid being pulled through the mixer.
Figure 13:
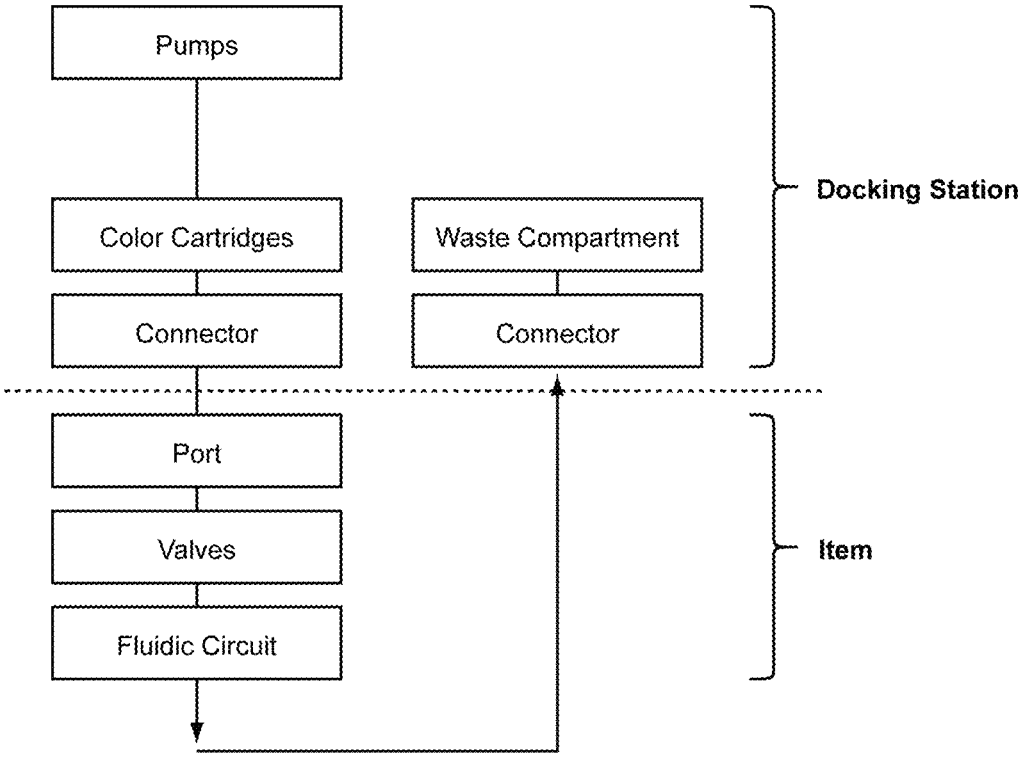
FIG. 13 is an example of a dock configuration with independent pumps on each of the fluid lines. No actuation valves are included.

Within certain embodiments where a docking station (the dock) is used to optionally mix and ultimately distribute fluid into the item. In certain embodiments, the dock my comprise a pump, actuation valve(s), color cartridge(s), a mixing element (a mixer), fluidic connector(s), a waste compartment, a combination thereof, or all of the above (FIG. 11, FIG. 12). In other embodiments each fluid channel carries its own pump (FIG. 13). Independently controlled pumps may obviate the need for actuation valves within the dock.

Mixer Designs within Docking Station

Figure 14:
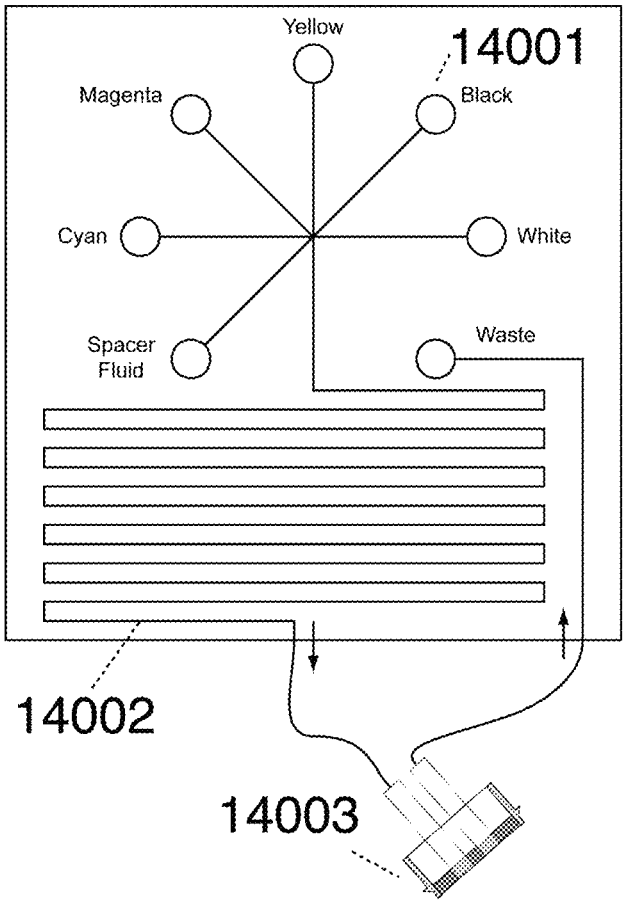
FIG. 14 is an example of a mixer configuration with a roughened channel, and input ports 14001 connected to the fluid cartridges (not shown). The roughened channel 14002 enables mixing. For instance, chaotic flow induced by herringbone grooves along the bottom of the channel would spatially compress mixing. Fluid exits the mixer into the connector 14003, flows through the microfluidic circuit, then returns through the connector into the waste compartment.
Figure 15:
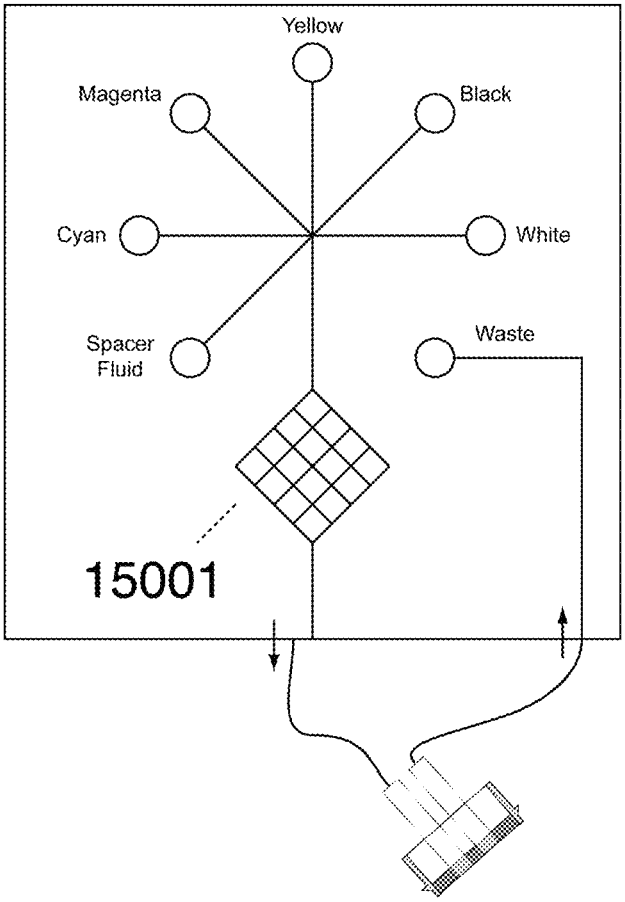
FIG. 15 is an example of another mixer configuration that takes advantage of flow splitting and recombination 15001 to promote mixing within a compressed path length.

Mixing of various fluids (e.g., different colors, such as primary colors) within the docking station can be achieved in any suitable manner including, e.g., the use of grooved channels, Tesla mixers, T- and Y-flow configurations, interdigital/bifurcation flow distribution structures, repeated flow division- and recombination structures, flow obstacles, zigzag channels, chaotic mixing, or other passive micromixing designs, flow splitting, hydrodynamic focusing, capillary flow splitting and recombination, flow twisting, chaotic advection, acoustic mixing, surface acoustic waves, heating, electromagnetic, magnetic, diffusion, or other active methods known to those skilled in the art of mixing within microfluidic channels. Examples of mixer designs are shown in FIG. 14 and FIG. 15.

Modulation of Fluid

Different levels of constituent fluids (i.e., cyan, magenta, yellow, black, white or clear color fluids, or alternatively red, green and blue fluids, or glittered, glow-in-the dark, fluorescent, and matte, or hot, cold, scented, therapeutic, magnetic, antiseptic, viscous, non-Newtonian fluids) can be mixed in different proportions to create a broad palette of colors, textures, therapeutic and other material properties. The different types of modulation can be broadly segregated into analog, digital, or temporal modalities.

In analog modulation, the amount of each fluid can be changed by varying the pressure on each line or by varying the resistance of each line given a single pressure. In the case where each fluid line is being forced by an independent pump, the pump pressure would be increased for more fluid, and lowered for less fluid. In such an embodiment, it may be useful to balance the overall pumping pressure to a relatively constant pressure that overcomes the forward valve pressure in the item, for instance the sum of all pressures could be kept the range of 3-12 psi.

In a second analog modulation method, a master pump is placed in the circuit while valves regulate the resistance on each line. The valves and pumps can be placed either before or after the fluid cartridges, and act upon the fluid lines, the fluid directly, or upon the airway to each cartridge. In one embodiment, each fluid line would contain a resistive valve that mediates the relative resistance through that line. In certain analog resistive modulation embodiments, indirect valves can be made to press on tubing with different amounts of force in order to compress the fluidic lines and increase resistance. Alternatively, indirect valves could constrict the flow of air to each fluid cartridge. In another analog embodiment, the fluid path passes directly through the resistive element of the valve. Analog systems would likely benefit from disposable tubing (such as in the case of indirect valves) to alleviate long-term plasticity on the fluid level calibration. Valves may be actuated by diaphragm, a screw being driven by a stepper motor, or by a solenoid valve, for example.

In a first digital embodiment, each fluid cartridge is connected to a plurality of valves, each of which is binary in nature, providing either flow or no flow, e.g. a solenoid valve. When a greater proportion of a single fluid is desired, a greater number of the binary valves are opened. Such an embodiment allows a well-defined palette and easily calibrated fluid choices. For instance, if each cartridge had four valves, each of which was driven by its own solenoid, and there were four colors of fluid (CMYK), a palette of 4^4=256 colors could be created.

Figure 16:
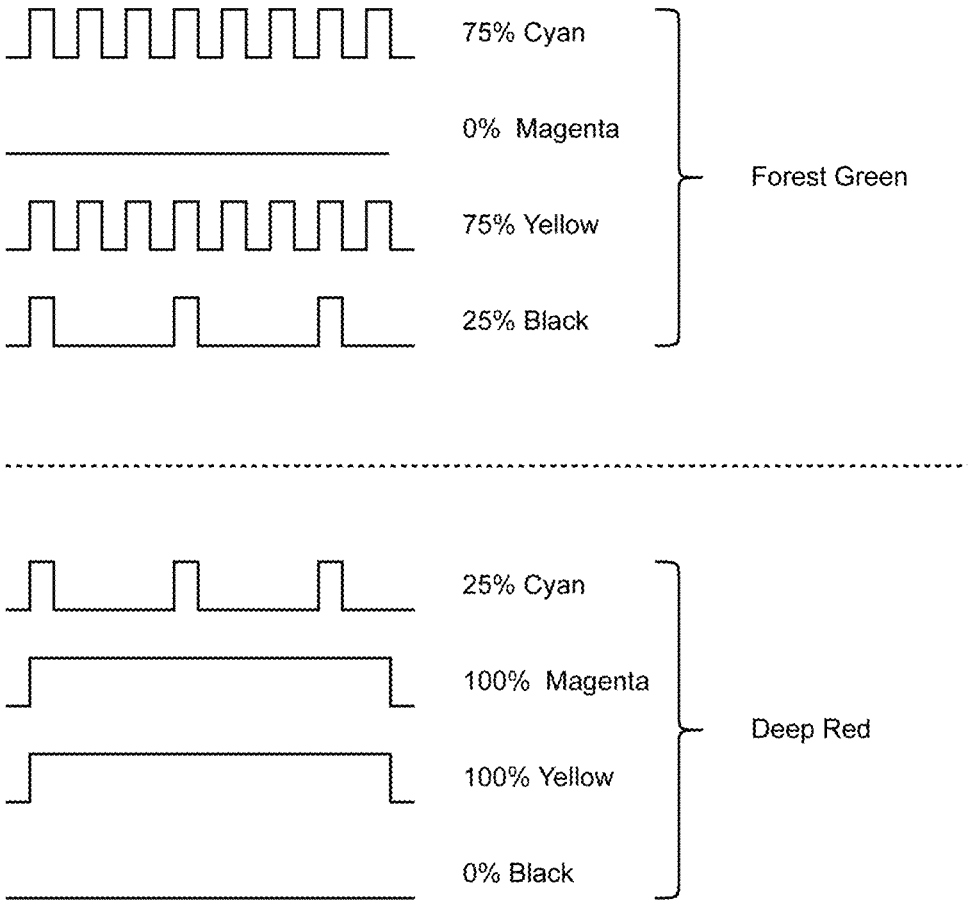
FIG. 16 gives an example of a time series of valve actuations in a temporal modulation paradigm.

Temporal modulation relies upon binary flow from each cartridge to be controlled through valves (or independent pumps). In this embodiment, valves are pulsed open or closed according to a schedule of relative duty cycles. Solenoid valves (one per fluid channel) would be particularly well suited for this approach. As fluids recombine through a microfluidic mixer, the output flow would be a reflection of the integral of duty cycle frequency and mixer path length. Shorter path lengths and faster modulation times would result in a higher resolution switching between fluid packets. An example of duty cycle scheduling is shown in FIG. 16.

Replacing Fluid within Microfluidic Circuits

There are several methods of replacing fluid within the microfluidic circuits and the fluids of a circuit described herein may be removed and inserted in any suitable manner. For instance, electrophoretic, electroosmotic, dielectrophoretic, electrothermal flow, electromagnetic, or other electromotive flow types; or pressure based flow (including piezoelectric, diaphragm, peristaltic, positive displacement, rotary pumps, manually operated bellows pumps and so forth). In one preferred embodiment, a 6 mL/minute piezoelectric diaphragm pump, with external dimensions of roughly 30×15×4 mm is placed on each fluidic channel. In another embodiment, a 2-roller peristaltic pump is placed after the outflow of the item to pull fluid through the microfluidic circuit, in which case independent valves would be used to modulate the level of each fluid flowing through the circuit.

In another embodiment, pre-mixed cartridges containing a single fluid and a connector to deliver fluid to the circuit. In such embodiments, the cartridges may be pre-pressurized and contain a valve that opens when connected to the item. Alternatively the user may use a bellows, syringe or a bulb attached to one end of the cartridge to manually pump the fluid through the item.

Replacing the fluid within microfluidic circuits is optionally achieved by replacing the resident fluids within the microfluidic circuit without flushing the circuit. In one embodiment, a bolus of air or immiscible fluid may precede the novel fluid to prevent mixing with the resident fluid. Alternatively, gradients of appearance or material properties can be created by continuously changing the constituent levels of fluid introduced into the circuit without introducing a bolus of immiscible fluid. An immiscible fluid utilized in certain embodiments herein may comprise a fluid with sufficient density to substantially alter its flow profile throughout the microfluidic circuit.

In one embodiment, the entire volume of the microfluidic circuit is filled with a single color fluid, or fluid with identical material properties. In yet other embodiments, microfluidic circuits can be filled with a series of fluid packets (volumes of fluid less than the entire circuit volume) to produce multiply colored or striped elements. In yet another embodiment, sequential aliquots of very small volume can be serially moved down the microfluidic circuit to create an image.

Compositions of Fluid

Fluids utilized in the circuits, items, or systems described herein include any suitable or desirable fluid. In specific embodiments, the fluid is a gel or a liquid (e.g., a solution, a suspension, a colloid, an emulsion, etc.). In some embodiments, liquids provided for herein are colored liquids. In further or alternative embodiments, liquids provided for herein comprise a suspended material, such as metallic particles, magnetic particles, reflective particles, or the like.

Colored fluids may be comprised of small molecules such as ethyl-[4-[[4-[ethyl-[(3-sulfophenyl)methyl]amino]phenyl]-(4-hydroxy-2-sulfophenyl)methylidene]-1-cyclohexa-2,5-dienylidene]-[(3-sulfophenyl)methyl], disodium 6-hydroxy-5-((2-methoxy-5-methyl-4-sulfophenyl)azo)-2-naphthalene-sulfonate, or 2,2'-Bis(2,3-dihydro-3-oxoindolyliden). Fluids may also be comprised of particle suspensions or polymer solutions. In certain embodiments, particles can be fashioned from polymeric nanoparticles, preferentially 50-200 nm in diameter with covalently bound (or absorbed) dye molecules, or in some configurations up to 20-50 μm. For instance, PMMA or polyethylene particles at a density of 0.99-1.01 g/cc can be used for optimal suspension in water. Bichromal, translucent, opaque, fluorescent, iridescent, opalescent, magnetic, gold, silver, drug-delivery, long-release, infrared or highly reflective particles can be used to impart additional qualities to the item. Small molecule dyes or pigments may also be bound to extended chain polymers (i.e., polyethylene glycol, PMMA etc.) and suspended in a solvent to mitigate staining of the fluidic channels. Fluids may be comprised of a small molecules, a functionalized polymer, nanoparticles, microparticles, or combinations therein.

In certain embodiments, optical properties can be altered by using a fluid comprised of dyes, pigments, polymeric dyes, nano- or microparticles with color molecules covalently attached, adsorbed, mixed, or otherwise attached. In other embodiments, scent can be altered by using a fluid comprised of small organic compounds, volatile aromatic compounds, perfumes, etc. In other embodiments, thermal properties can be altered by using a fluid comprised of boron nitride, aluminum, copper particles to increase the heat transfer coefficient, ceramics, metal particles, or other polymers. In other embodiments, mechanical properties can be altered by using a fluid comprised of high viscosity liquids such as higher concentrations of polyethylene glycol to control stiffness of the equipment of apparel. In other embodiments thixotropic, shear thickening, shear thinning, or other non-Newtonian fluids can be added to modulate the modulus of elasticity of the apparel or equipment. In other embodiments, mechanical properties can be altered by using a fluid comprised of large microparticles to distend the microfluidic circuit to add texture to apparel or equipment. In other embodiments, electromagnetic properties can be altered by using a fluid comprised of iron particles to increase the Chi of the apparel or equipment. In other embodiments, therapeutic properties can be altered by using a fluid comprised of pharmaceutical compounds such as non-steroidal anti-inflammatory compounds, corticosteroids, local anesthetics such as lidocaine, vasodilator, vasoconstrictor, or antiseptics. In such embodiments, the porosity or permeability of the microfluidic circuit may be enhanced by interactions with the apparel or equipment, e.g., walking on a therapeutic shoe, body heat in a therapeutic vest, flexing a therapeutic wristband.

Cartridges & Dye Materials

Cartridges used in any system described herein may take any suitable form. In one embodiment, a cartridge provided for herein comprises a plastic container that contains either dry and/or wet color materials. In certain embodiments where the cartridges contain fluid, the cartridges could be sealed on top with a compliant plastic bag that would expand into the void of the cartridge as the colored fluid is pumped out of the cartridge. Cartridges can be connected to the mixing manifold by luer locks, tubes, septum valves, etc. Prior to insertion into the dock, the cartridges could be sealed by a tab or a valve. If shipped with dessicated ink, the cartridges could be open to the air, and the dock could push fluid through them to reconstitute and deliver the color. In certain embodiments, fluidic cartridges contain a waste compartment to receive fluid from the outlet of the microfluidic circuit.

Docking Station Sensors

In order to accommodate microfluidic circuits of different volumes, e.g., in the case of different sized shoes, the docking station may include sensors substanially configured to measure fluid properties of the microfluidic circuit. Such sensors can be incorporated within the extent of the docking station or alternatively within the connector to observe the flow at the inlet or outlet. In certain embodiments where a homogeneous fluid is required throughout the circuit, fluid flows until the the color at the outlet matches the color at the inlet within a desired tolerance. In other embodiments, fluid flows until the color at the outlet matches the preselected color to a desired tolerance. Incorporation of a sensor network within the docking station allows the fluid transfer interface to be guided by a control system (PID, PI, negative feedback, and so forth) to regulate pressures within operable limits. In certain pumps, such as serial piezoelectric pumps, sensors can be integrated into the pump head to facilitate pressure balancing. The dock may include a variety of types of sensors, including flow sensors, pressure sensors, and optical sensors. Within embodiments containing optical sensors, the dock may further comprise a light source to illuminate the dye within the microfluidic circuit to enable facilitate optical sensing; for instance, through the use of a plurality of light emitting diodes, filaments, or fluorescent sources. The dock may also be comprised of ultrasonic or acoustic sensors to detect flow.

One preferred method of active feedback to indicate to the dock when start and stop flow is to incorporate a "start codon" or a "stop codon" of fluid and or air so that a very clear signal is sent to the docking station upon reaching the end of the previous fluid pattern. These codons can be comprised of a high frequency pattern of air and color, for instance five air pulses and five black pulses in a row. In such an embodiment, codons would precede or follow every fluid injection cycle, and would be easily recognizable during sensing.

User Interfaces

In certain embodiments, the user interface can be running on a computer or phone connected to the docking station (through USB, 802.11 wireless, bluetooth, infrared, internet, etc.) wherein the interface allows the user to control the color of individual compartments of the item. Color selections can be made through an on-screen color wheel, eyedropper tool to sample a color from a picture, or through a mobile application that allows image sampling and subsequent selection of color preferences. In certain embodiments, the user manually selects a color (or image, or portion of an image) from an image uploaded to the screen via camera, phone, internet, etc. Color parameters can also be downloaded and shared through a network that allows social networking with friends to coordinate item colors for that day. Color parameters can be selected automatically through crowdsourcing, data mining, pushed from central servers, and so forth. In one embodiment, basketball teams can coordinate shoe colors for home and away games through a social network. In another embodiment, marketing efforts can distribute codes to correspond to select color palettes on certain days. In yet another embodiment, complimentary color combinations are applied across a broad variety of items, such as shoes, backpacks, hats and belts. In other embodiments, the user preferences may extend to material properties other than color.

In other embodiments, the dock would not contain a mixing element and the choices in the user interface would be constrained to the current panel of colors within the dock. For instance, a single color cartridge could be swapped out of the dock at a time. In this embodiment, the interface could be appropriately simplified, using a single push-button on the dock to initiate pumping of fluid. Flow could also be automatically initiated upon connecting the item to the single colored dock.

Communication of preferred volume and pressure parameters between the item and docking station can be facilitated by an EEPROM or RFID tag within the apparel or equipment. Such a communication paradigm would allow parameters of the equipment or apparel to be sent to the dock, for instance, volume of the fluidic channel, number and location of valves, type of fluidic channel, preferential pressure algorithms, item identification, or any other data that would facilitate efficient modulation of appearance or material properties. In yet other embodiments, the user would enter a code representing the pertinent details of item.

Figure 17:
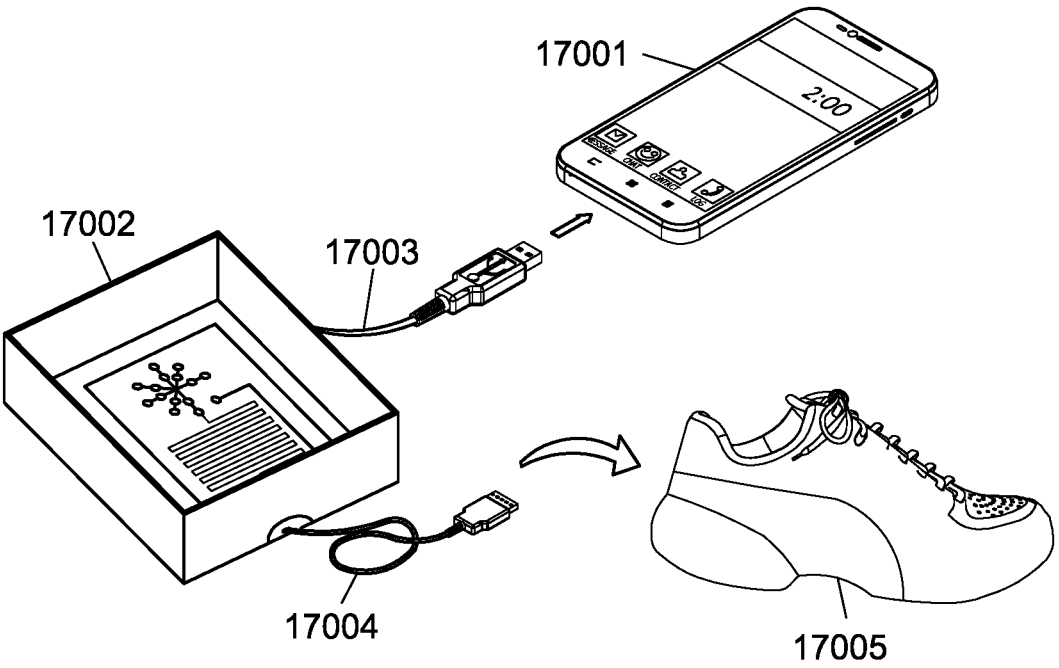
FIG. 17 gives an example of a workflow for changing the color of an item. The user would connect a computer 17001 (or iPhone, in the example) to the docking station through USB connector 17003. The user attaches the fluidic connector 17004 to the port of the shoe 17005. Upon connection, the connector illuminates to provide feedback to the user that the connection has been made 17006. Using the graphical user interface on the computer 17001, the user selects the extent of the item they would like to change 17007, then command the docking station to deliver the appropriate color. The dock can be configured to fill one or more items at a time. In the case of shoes, the dock can be configured to fill two shoes at once.
Figure 17:
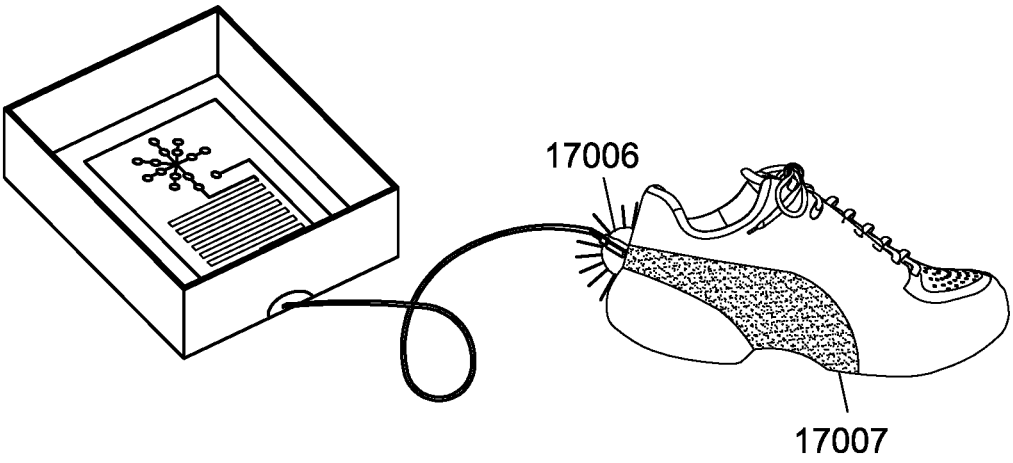

Once the item has been identified, the user interface software can query a central server to retrieve essential valving, volume and pressure parameters. Codes could also be used to retrieve relevant metadata that enhances a user experience. The metadata could include three-dimensional models of the item, social networking enhanced profiles of friends or users of similar items. Metadata could also be comprised of shared parameter sets (i.e., color combinations, appearance, or other material properties) derived from friends, celebrities, sports figures, authorities (coaches, athletic directors, marketing directors, art directors, etc.), or promotional materials (television giveaways, soda caps, etc.). Metadata could also be made to be malleable across apparel and equipment; for instance, color schemes for multiple design elements within shoes, logos on hats, and ribbing within sporting equipment could be coordinated through the hierarchical assignment of valve priorities (where each item would have a primary valve set, secondary valve set, etc., and the color programs would be coordinated between items). An example of the workflow is shown in FIG. 17.

What is claimed is:

1. An article comprising:

a microfluidic channel comprising a transparent or translucent region visible on an exterior surface of the article;

an inlet port fluidly coupled to the microfluidic channel, wherein the inlet port is configured to releasably couple to a fluid source;

an outlet port fluidly coupled to the microfluidic channel, wherein the inlet port and the outlet port are co-located on an exterior region of the article;

a first fluid disposed in the transparent or translucent region of the microfluidic channel, wherein the fluid imparts a color on a visible exterior of the article, a second fluid disposed in the microfluidic channel; and a plug disposed in the microfluidic channel, wherein the plug is disposed between the first fluid and the second fluid, and wherein the plug is immiscible in the first fluid and the second fluid.

2. The article of claim 1, wherein the transparent or translucent region of the microfluidic channel comprises a serpentine path.

3. The article of claim 2, wherein dimensions of the microfluidic channel vary along the serpentine path.

4. The article of claim 1, wherein the first fluid comprises a substance selected from the group consisting of a dye, pigment, and particle, wherein the substance is configured to impart an optical property for the fluid.

5. The article of claim 1, wherein the first fluid does not comprise a magnetic particle.

6. The article of claim 1, wherein the inlet port and the outlet port are at least partially disposed in a housing.

7. The article of claim 1, wherein the article is apparel.

8. The article of claim 1, wherein the microfluidic channel covers at least 10% of an exterior of the article.

9. The article of claim 1, wherein the fluid is configured to remain fluidic after at least 24 hours under ambient conditions.

10. A method for modulating color of an article, wherein the article comprises a microfluidic channel, and wherein the microfluidic channel comprises a transparent or translucent region visible on an exterior surface of the article, the method comprising:

applying a pressure to flow a first fluid through an inlet into the transparent or translucent region of the microfluidic channel, wherein the first fluid has a first color;

flowing a second fluid through an outlet exiting the transparent or translucent region of the microfluidic channel, wherein the second fluid has a second color that is different than the first color, and wherein the pressure applied to the first fluid flowing through the inlet of the microfluidic channel forces a volume of the second fluid disposed in the microfluidic channel through the outlet; and flowing a plug in the microfluidic channel, wherein the plug is disposed between the first fluid and the second fluid, and wherein the plug is immiscible in the first fluid and the second fluid.

11. The method of claim 10, wherein the microfluidic channel has at least one dimension less than about 1 mm.

12. The method of claim 10, wherein the first fluid exhibits laminar flow in the transparent or translucent region of the microfluidic channel.

13. The method of claim 10, wherein the first fluid comprises a substance selected from the group consisting of a dye, a pigment, and a particle, wherein the substance is configured to impart an optical property for the first fluid.

14. The method of claim 10, wherein the transparent or translucent region of the microfluidic channel comprises a serpentine path.

15. The method of claim 14, wherein dimensions of the microfluidic channel vary along the serpentine path.

16. The method of claim 10, wherein the article comprises a second microfluidic channel comprising a second inlet and a second outlet, and wherein the method comprises flowing a third fluid into the second microfluidic channel through the second inlet, wherein the third fluid has a third color that is different than the first color.

17. The method of claim 10, wherein the article is apparel.

18. A docking station, wherein the docking station is configured to receive an article comprising a microfluidic channel coupled to an inlet port and an outlet port, the docking station comprising:

a reservoir comprising a first fluid;

a waste reservoir configured to receive a second fluid and a plug from the outlet port of the microfluidic channel of the article;

an outlet channel configured to fluidly couple the reservoir and the inlet port of the microfluidic channel of the article; and a pump configured to: (i) displace the first fluid through the outlet channel into the inlet port of the microfluidic channel; and (ii) displace the second fluid and the plug through the outlet port of the microfluidic channel into the waste reservoir when the article is received into the docking station, wherein the plug is immiscible in the first fluid and the second fluid.

19. The docking station of claim 18, wherein the pump is configured to produce laminar flow within at least a portion of the microfluidic channel when displacing the first fluid through the outlet channel into the inlet port of the microfluidic channel.

20. The docking station of claim 18, wherein the first fluid comprises a substance selected from the group consisting of a dye, a pigment, and a particle, wherein the substance is configured to impart an optical property for the fluid.

* * * * *